US008597863B2

(12) United States Patent
Kami et al.

(10) Patent No.: US 8,597,863 B2
(45) **Date of Patent: *Dec. 3, 2013**

(54) ELECTROPHOTOGRAPHIC PHOTORECEPTOR, METHOD OF MANUFACTURING ELECTROPHOTOGRAPHIC PHOTORECEPTOR, PROCESS CARTRIDGE, AND IMAGE FORMING APPARATUS

(75) Inventors: Hidetoshi Kami, Numazu (JP); Yukio Fujiwara, Numazu (JP); Kazuhiro Egawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

This patent is subject to a terminal disclaimer.

(21) Appl. No.: 12/816,277

(22) Filed: Jun. 15, 2010

(65) Prior Publication Data

US 2010/0316423 A1 Dec. 16, 2010

(30) Foreign Application Priority Data

Jun. 16, 2009 (JP) ..... 2009-142962

(51) Int. Cl.
*G03G 5/043* (2006.01)
*G03G 15/06* (2006.01)

(52) U.S. Cl.
USPC ..... 430/66; 430/56; 399/111; 399/116

(58) Field of Classification Search
USPC ..... 430/58.7, 66, 56; 399/123, 111, 116
See application file for complete search history.

(56) References Cited

U.S. PATENT DOCUMENTS 4,772,525 A 9/1988 Badesha et al.

(Continued)

FOREIGN PATENT DOCUMENTS

JP 57-78402 5/1982

(Continued)

OTHER PUBLICATIONS

Hyakutake et al. (2001), "Blade cleaning system for polymerized and small size toner", Japan Hardcopy Fall Meeting, pp. 24-27.

(Continued)

*Primary Examiner* — Jonathan Jelsma
(74) *Attorney, Agent, or Firm* — Cooper & Dunham LLP

(57) ABSTRACT

An electrophotographic photoreceptor including a conductive substrate, a photosensitive layer, and a cross-linked resin surface layer comprising a cross-linked resin having a charge transport structure, which satisfies the following inequations:

$$0.01<WRa(LLH)<0.04 \quad (1\text{-}1)$$

$$0.01<WRa(LML)<0.04 \quad (1\text{-}2)$$

$$0.01<WRa(LMH)<0.04 \quad (1\text{-}3)$$

$$0.01<WRa(LHL)<0.04 \quad (1\text{-}4)$$

$$WRa(LHL)>WRa(LHH) \quad (2\text{-}1)$$

$$WRa(LHL)>WRa(HLH) \quad (2\text{-}2)$$

$$WRa(LHL)>WRa(HML) \quad (2\text{-}3)$$

$$WRa(LHL)>WRa(HMH) \quad (2\text{-}4)$$

$$WRa(LHL)>WRa(HHL) \quad (2\text{-}5)$$

$$WRa(LHL)>WRa(HHH) \quad (2\text{-}6)$$

wherein WRa (μm) represents an arithmetic average roughness according to JIS-B0601:2001 of frequency components that are obtained by subjecting a one-dimensional data array of a surface profile of the electrophotographic photoreceptor to a wavelet transformation multiresolution analysis.

5 Claims, 22 Drawing Sheets

(56) References Cited

U.S. PATENT DOCUMENTS

| | | | | |
|---|---|---|---|---|
| 5,187,039 | A | 2/1993 | Meyer | |
| 6,143,452 | A | 11/2000 | Sakimura et al. | |
| 6,180,303 | B1 | 1/2001 | Uematsu et al. | |
| 8,293,439 | B2 | 10/2012 | Fujiwara et al. | |
| 2002/0018947 | A1 | 2/2002 | Kabata et al. | |
| 2002/0081130 | A1 | 6/2002 | Endo et al. | |
| 2002/0160287 | A1 | 10/2002 | Miyamoto et al. | |
| 2004/0234294 | A1 | 11/2004 | Nagame et al. | |
| 2005/0255393 | A1 | 11/2005 | Nakata et al. | |
| 2005/0266328 | A1* | 12/2005 | Yanagawa et al. | 430/66 |
| 2006/0008717 | A1 | 1/2006 | Uematsu et al. | |
| 2006/0019185 | A1 | 1/2006 | Amamiya et al. | |

FOREIGN PATENT DOCUMENTS

| | | |
|---|---|---|
| JP | 63-285552 | 11/1988 |
| JP | 4-243265 | 8/1992 |
| JP | 7-104497 | 4/1995 |
| JP | 7-292095 | 11/1995 |
| JP | 8-248663 | 9/1996 |
| JP | 2000-66424 | 3/2000 |
| JP | 2000-162881 | 6/2000 |
| JP | 2000-171990 | 6/2000 |
| JP | 2001-265014 | 9/2001 |
| JP | 2001-289630 | 10/2001 |
| JP | 2001-330973 | 11/2001 |
| JP | 2002-82468 | 3/2002 |
| JP | 2002-196645 | 7/2002 |
| JP | 2002-251029 | 9/2002 |
| JP | 2002-258705 | 9/2002 |
| JP | 2002-296822 | 10/2002 |
| JP | 2002-296823 | 10/2002 |
| JP | 2002-296824 | 10/2002 |
| JP | 2002-296994 | 10/2002 |
| JP | 2002-341572 | 11/2002 |
| JP | 2003-131537 | 5/2003 |
| JP | 2003-241408 | 8/2003 |
| JP | 2003-270840 | 9/2003 |
| JP | 2004-54001 | 2/2004 |
| JP | 2004-61359 | 2/2004 |
| JP | 2004-117454 | 4/2004 |
| JP | 2004-138643 | 5/2004 |
| JP | 2004-144859 | 5/2004 |
| JP | 2004-258588 | 9/2004 |
| JP | 2005-99688 | 4/2005 |
| JP | 2005-345788 | 12/2005 |
| JP | 2006-53576 | 2/2006 |
| JP | 2006-53577 | 2/2006 |
| JP | 2006-79102 | 3/2006 |
| JP | 2006-163302 | 6/2006 |
| JP | 2007-79244 | 3/2007 |
| JP | 2007-86319 | 4/2007 |
| JP | 3938209 | 4/2007 |
| JP | 3938210 | 4/2007 |
| JP | 2007-264347 | 10/2007 |
| JP | 2007-292772 | 11/2007 |
| JP | 2008-122869 | 5/2008 |
| JP | 2008-275941 | 11/2008 |

OTHER PUBLICATIONS

Mizuguchi et al. (2004), "Measuring Non-Electrostatic Adhesive Force between Solid Surfaces and Particles by Means of Atomic Force Microscopy", Konika Minolta Technology Report vol. 1, pp. 19-22.

Japanese official action dated Jul. 11, 2013 in corresponding Japanese patent application No. 2009-142962.

* cited by examiner

ELECTROPHOTOGRAPHIC PHOTORECEPTOR, METHOD OF MANUFACTURING ELECTROPHOTOGRAPHIC PHOTORECEPTOR, PROCESS CARTRIDGE, AND IMAGE FORMING APPARATUS

CROSS-REFERENCE TO RELATED APPLICATIONS

The present patent application claims priority pursuant to 35 U.S.C. §119 from Japanese Patent Application No. 2009-142962, filed on Jun. 16, 2009, which is hereby incorporated by reference herein in its entirety.

BACKGROUND

1. Field of the Invention

The present invention relates to an electrophotographic photoreceptor for use in copiers, facsimile machines, laser printers, and direct digital platemakers. The present invention also relates to a method of manufacturing electrophotographic photoreceptors, and a process cartridge and an image forming apparatus using the electrophotographic photoreceptor.

2. Description of the Background

Recently, the main type of electrophotographic photoreceptor (hereinafter simply "photoreceptor") has switched from inorganic photoreceptors that use inorganic materials such as selenium, zinc oxide, and cadmium sulfide, to organic photoreceptors that use organic materials. Organic photoreceptors are more advantageous than inorganic photoreceptors in reducing environmental impact and manufacturing cost, and provide more design flexibility. At present, the organic photoreceptors account for close to 100% of the total production of photoreceptors. Recently, attempts are being made to use organic photoreceptors as mechanical components rather than consumable supplies in accordance with increasing momentum toward global environmental protection.

Various attempts have been made to improve the durability of organic photoreceptors. For example, Japanese Patent Application Publication No. (hereinafter "JP-A") 2000-66424 (corresponding to Japanese Patent No. 4011790) and JP-2000-171990-A have proposed forming a cross-linked resin layer and a zol-gel cured resin layer, respectively, on the surface of a photoreceptor. The former is more productive because the layer is likely to neither fracture nor crack even when an electron transport material is added thereto. In particular, radical-polymerized acrylic resins are advantageous because they are stiff and provide the resultant photoreceptor with high photosensitivity. Because they include plural chemical bonds, such cross-linked or cured resin layers may not be immediately abraded even when a part of chemical bonds are cut by application of mechanical stress.

On the other hand, the main type of electrophotographic toner (hereinafter simply "toner") is switching from irregular-shaped toner to spherical toner. Spherical toners have an advantage in terms of production of high quality images.

Generally, spherical toners are manufactured through chemical manufacturing processes such as a suspension polymerization process, an emulsion aggregation polymerization process, an ester elongation process, or a dissolution suspension process. Hereinafter, spherical toners may be referred to as "polymerization toners" as appropriate. A typical polymerization toner for use in an electrophotographic image forming apparatus may have an average circularity of from 0.95 to 0.99 and shape factors SF-1 and SF-2 of from 110 to 140. A true sphere has a circularity of 1.0 and shape factors of 100.

Having a uniform shape, each polymerization toner particles has a uniform charge quantity. Therefore, polymerization toner particles develop a latent image into a toner image with high sharpness, resolution, and gradation. In addition to this high developability, polymerization toner particles also have high transfer efficiency. Also, because polymerization toner particles are able to include wax, advantageously, fixing oil is not needed when fixed on a recording medium such as paper. At the same time, disadvantageously, polymerization toner particles are difficult to remove when remaining on a photoreceptor after image development. To solve this problem, a greater amount of external additives is required on the surfaces of the polymerization toner particles, one consequence of which is that the external additives may form a film on the photoreceptor.

In order to more effectively remove residual polymerization toner particles from a photoreceptor, one proposed approach involves applying a solid lubricant (e.g., zinc stearate) to a surface of a photoreceptor to reduce the surface friction coefficient thereof, as described in a technical document entitled "Blade cleaning system for polymerized and small size toner, Hyakutake et al., Japan Hardcopy Fall Meeting, 2001, 24-27".

However, it is known that the receptivity of a photoreceptor to solid lubricants may affect abrasion rate of the photoreceptor and/or cleanability (removability) of toner, i.e., printing quality. Yet, a technique to improve the receptivity of a highly durable photoreceptor having a cross-linked resin surface layer has not been proposed so far.

JP-2004-61359-A and JP-2007-292772-A disclose a method of evaluating surface roughness of a component for an image forming device, which evaluates local variations in the surface with high sensitivity and accuracy. Specifically, a cross-section curve defined by JIS B0601 is found on the surface of the component and multiple resolution analysis is performed on positional data rows in a surface roughness direction at equally spaced positions on the cross-section curve, and the state of the surface roughness is evaluated at least based on the result.

Advantageously, such a photoreceptor having a surface layer such as a cross-linked resin layer has extremely high durability. On the other hand, disadvantageously, such a surface layer has a low receptivity to solid lubricants and therefore cleanability (removability) of polymerization toners is poor. As a result, at present highly durable photoreceptors having a cross-linked resin surface layer cannot be practically used in combination with polymerization toners.

SUMMARY

Exemplary aspects of the present invention are put forward in view of the above-described circumstances, and provide a novel electrophotographic photoreceptor having good receptivity to solid lubricants, a novel method of manufacturing such an electrophotographic photoreceptor having good receptivity to solid lubricants, and novel process cartridge and image forming apparatus having a long lifespan.

In one exemplary embodiment, a novel electrophotographic photoreceptor includes a conductive substrate, a photosensitive layer located overlying the conductive substrate, and a cross-linked resin surface layer comprising a cross-linked resin having a charge transport structure, located overlying the photosensitive layer. The electrophotographic photoreceptor satisfies the following inequations:

$$0.01<WRa(LLH)<0.04 \quad (1\text{-}1)$$

$$0.01<WRa(LML)<0.04 \quad (1\text{-}2)$$

$$0.01<WRa(LMH)<0.04 \quad (1\text{-}3)$$

$$0.01<WRa(LHL)<0.04 \quad (1\text{-}4)$$

$$WRa(LHL)>WRa(LHH) \quad (2\text{-}1)$$

$$WRa(LHL)>WRa(HLH) \quad (2\text{-}2)$$

$$WRa(LHL)>WRa(HML) \quad (2\text{-}3)$$

$$WRa(LHL)>WRa(HMH) \quad (2\text{-}4)$$

$$WRa(LHL)>WRa(HHL) \quad (2\text{-}5)$$

$$WRa(LHL)>WRa(HHH) \quad (2\text{-}6)$$

wherein WRa (μm) represents an arithmetic average roughness according to JIS-B0601:2001 of frequency components that are obtained by subjecting a one-dimensional data array of a surface profile of the electrophotographic photoreceptor, measured with a surface roughness and profile shape measuring instrument, to a wavelet transformation multiresolution analysis so as to be separated into six frequency components, HHH, HHL, HMH, HML, HLH, and HLL, each having a cycle length (μm) of 0 to 3, 1 to 6, 2 to 13, 4 to 25, 10 to 50, and 24 to 99, respectively; thinning a one-dimensional data array of the lowest frequency component HHL having a cycle length of from 24 to 99 (μm) so that the number of data arrays is reduced to from 1/10 to 1/100; and subjecting the thinned one-dimensional data array to the wavelet transformation multiresolution analysis so as to be separated into six frequency components, LHH, LHL, LMH, LML, LLH, and LLL, each having a cycle length (μm) of 26 to 106, 53 to 183, 106 to 318, 214 to 551, 431 to 954, and 867 to 1,654, respectively.

In another exemplary embodiment, a novel method of manufacturing an electrophotographic photoreceptor includes forming a photosensitive layer that dissolves in an organic solvent; spraying the organic solvent on the photosensitive layer so that the photosensitive layer satisfies the following inequations:

$$0.01<WRa(LLH)<0.07 \quad (3\text{-}1)$$

$$0.01<WRa(LML)<0.07 \quad (3\text{-}2)$$

$$0.01<WRa(LMH)<0.07 \quad (3\text{-}3)$$

$$0.01<WRa(LHL)<0.07 \quad (3\text{-}4); \text{ and}$$

forming a cross-linked resin surface layer by coating the photosensitive layer with a coating liquid. The WRa are obtained by the same method as above.

In yet another exemplary embodiment, a novel process cartridge includes the above-described electrophotographic photoreceptor and a solid lubricant applicator. The solid lubricant applicator includes a solid lubricant, a brush-shaped roller that scrapes the solid lubricant and applies the scraped solid lubricant to a surface of the electrophotographic photoreceptor, and a blade that evenly spreads the solid lubricant over the surface of the electrophotographic photoreceptor.

In further exemplary embodiment, a novel image forming apparatus includes at least one process unit each including the above-described electrophotographic photoreceptor to bear an electrostatic latent image, the above-described solid lubricant applicator, and a developing device that develops the electrostatic latent age with a toner to form a toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

First, a general application mechanism of a solid lubricant to a surface of a photoreceptor in an electrophotography is described in detail.

A solid lubricant in a powder state is applied to a surface of a photoreceptor in a small amount. More specifically, for example, a block-shaped solid lubricant is scraped with a brush-shaped applicator and is applied to a surface of a photoreceptor. Such a procedure can be performed by a simple apparatus and is able to reliably apply a solid lubricant to the entire surface of a photoreceptor.

Figure 1:
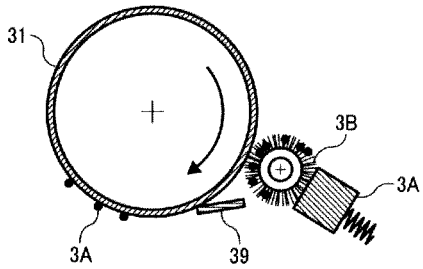
FIG. 1 is a schematic view illustrating an exemplary embodiment of a solid lubricant applicator.

FIG. 1 is a schematic view illustrating an exemplary embodiment of a solid lubricant applicator. An application brush 3B, such as a fur brush, rotates so as to scrape a solid lubricant 3A and apply it to a photoreceptor 31. The application brush 3B rotates while contacting the solid lubricant 3A so that a part of the solid lubricant 3A is scraped off. The scraped solid lubricant 3A adheres to the application brush 3B, and the application brush 3B applies the scraped solid lubricant 3A to the photoreceptor 31 by rotation. Because the scraped solid lubricant 3A that is in a powder state may not express lubricity, the scraped solid lubricant 3A is spread with an application blade 39 to form a thin film thereof over the photoreceptor 31.

The solid lubricant 3A may be a higher fatty acid metal salt such as zinc stearate, for example. Zinc stearate is a lamella crystal, which is preferably used as the solid lubricant. Lamella crystals generally have a layered structure in which amphiphilic molecules are self-assembled, and easily fracture along the interfaces between the layers upon application of shear force. Accordingly, a lamella crystal may cover the entire surface of a photoreceptor upon application of shear force to reduce the friction coefficient even in a small amount.

There are various methods of controlling solid lubricant application conditions. One exemplary method includes increasing the contact pressure of the solid lubricant 3A with the application brush 3B. Another exemplary method includes controlling the revolution speed of the application brush 3B.

Photoreceptors are generally required to be sensitive to adhesion of solid lubricants. Such a sensitivity of photoreceptors to adhesion of solid lubricants may be influenced by 1) the adhesive force between a photoreceptor and a solid lubricant and/or 2) the ease of formation of a thin film of a solid lubricant with an application blade.

For example, the adhesive force between two substances is studied in a technical document entitled "Measuring Non-Electrostatic Adhesive Force between Solid Surfaces and Particles by Means of Atomic Force Microscopy, Mizuguchi et al. KONICA MINOLTA TECHNOLOGY REPORT VOL. 1 (2004), 19-22". It is considered therein that the adhesive force between two substances is influenced by non-electrostatic attractive force, electrostatic attractive force, and the contact area therebetween. The electrostatic attractive force may be generated from a contact potential difference. The non-electrostatic attractive force may be generated from a difference in surface energy (e.g., wettability).

Generally, solid lubricants have low adhesive property. Therefore, the adhesive force between a solid lubricant and a photoreceptor is unlikely to drastically increase even if various surface controlling agents are included in the surface of the photoreceptor. In view of this situation, the inventors of the present invention focused on the contact area therebetween.

Figure 2:
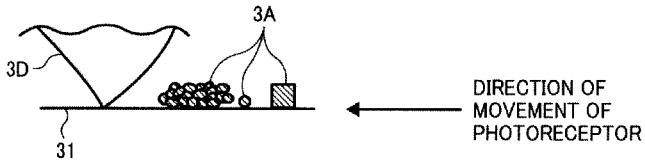
FIGS. 2 to 7 are schematic views illustrating various application conditions of a solid lubricant to a photoreceptor.
Figure 3:
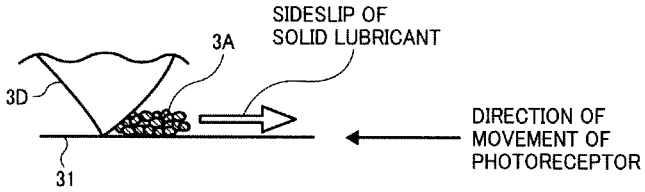
Figure 4:
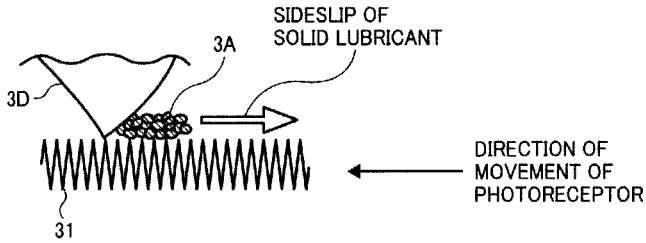

FIGS. 2 to 7 are schematic views illustrating various application conditions of a solid lubricant to a photoreceptor. As illustrated in FIG. 2, the solid lubricant 3A adhering to the photoreceptor 31 is in the form of a powder, an aggregation, or a solid block. When the surface of the photoreceptor 31 is smooth as illustrated in FIG. 3, the solid lubricant 3A cannot pass through an edge 3D of the application blade 39 and sideslips on the photoreceptor 31, and consequently releases from the surface of the photoreceptor 31. By contrast, when the surface of the photoreceptor 31 has extreme irregularities as illustrated in FIG. 4, the solid lubricant 3A point-contacts the photoreceptor 31 and consequently releases from the surface of the photoreceptor 31 as well.

Figure 5:
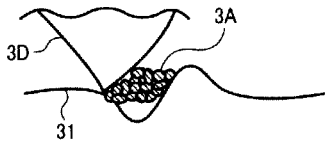

When the irregularities are not cyclic, sideslip of the solid lubricant 3A is prevented. However, in this case, the aggregation of the solid lubricant 3A point-contacts edges of the irregularities, as illustrated in FIG. 5, and consequently releases from the surface of the photoreceptor 31 as well.

Figure 6:
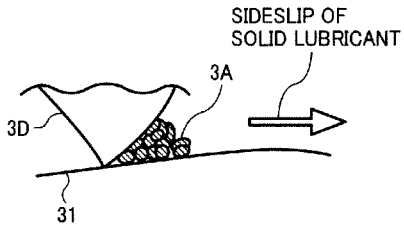
Figure 7:
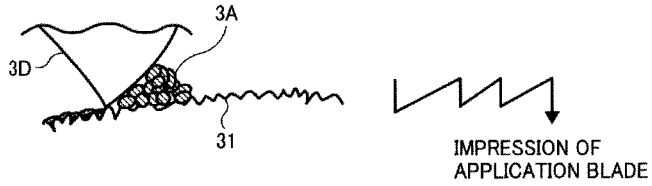

When the surface has gentle irregularities as illustrated in FIG. 6, the solid lubricant 3A may pass through the edge 3D of the application blade 39 or may be spread over the surface of the photoreceptor 31, depending on the linear pressure of the application blade 39. When high-frequency irregularities are further superimposed on the gentle irregularities that prevent sideslip of the solid lubricant 3A, as illustrated in FIG. 7, the solid lubricant 3A more strongly adheres to the photoreceptor 31.

Such irregularities can be formed on the surface of the photoreceptor 31 by, for example, adding a material capable of changing the surface profile, such as a filler, to the surface layer of the photoreceptor 31, modifying the manufacturing process of the photoreceptor 31, or mechanically processing the photoreceptor 31. However, none of these methods can adequately control the resulting surface profile.

Figure 8:
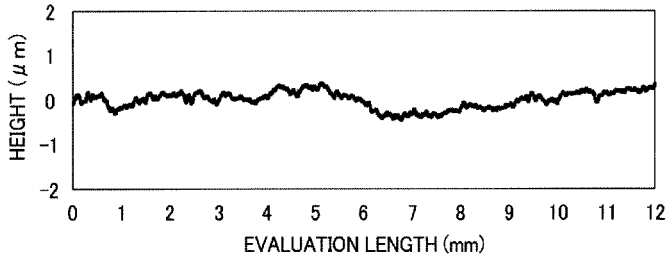
FIG. 8 shows an example of a surface profile of a photoreceptor.

More specifically, neither abrasion with an abrasive nor addition of a filler can form gentle irregularities, while the shapes of the sand grains of the abrasive or the filler particles are translated into the surface profile. In view of this situation, the photoreceptors according to the present specification are generally obtained as follows to have gentle irregularities on the resulting surface. Namely, after forming a photosensitive layer on a conductive substrate, a solvent is sprayed on the surface of the photosensitive layer so that the surface dissolves to some extent to form irregularities thereon. Subsequently, a cross-linked resin surface layer is formed thereon. An example of the resulting surface profile is illustrated in FIG. 8.

The surface roughness of a photoreceptor cannot be satisfactorily controlled only by monitoring conventional parameters such as Ra and RSm which are measurable with a surface roughness and profile shape measuring instrument, as described above. In view of this situation, the inventors of the present invention found that the surface roughness of a photoreceptor can be satisfactorily controlled by wavelet transformation multiresolution analysis of a one-dimensional data array of a cross-sectional curve of the photoreceptor.

A procedure of the wavelet transformation multiresolution analysis is described in detail below.

First, a surface of a photoreceptor is subjected to a measurement of a one-dimensional data array of a primary profile that is defined in JIS B0601:2001. The one-dimensional data array may be a digital signal directly obtained from a surface roughness and profile shape measuring instrument or that obtained by analog-digital conversion of an analog output of a surface roughness and profile shape measuring instrument.

According to JIS B0601:2001, the evaluation length is preferably from 8 to 25 mm. The sampling length is preferably 1 μm or less, and more preferably from 0.2 to 0.5 μm.

For example, when the evaluation length is 12 mm and the number of sampling points is 30,720, the sampling length becomes 0.390625 μm, which is within the above preferable range.

The one-dimensional data array is subjected to wavelet transformation multiresolution analysis so as to be separated into plural frequency components, ranging from high-frequency components to low-frequency components. A one-dimensional data array of the lowest-frequency component is thinned and further subjected to wavelet transformation multiresolution analysis so as to be separated into plural frequency components. The arithmetic average roughness WRa is calculated from each of the frequency components based on a method of calculating the arithmetic average roughness Ra that is defined in JIS B0601:2001.

As described above, wavelet transformation multiresolution analysis is performed twice. For the sake of simplicity, the first and second wavelet transformation multiresolution analysis may be hereinafter represented as MRA-1 and MRA-2, respectively. The frequency components are distinguished by prefixes H and L indicating the results of the first and second wavelet transformation, respectively.

Mother wavelet functions usable for the first and second wavelet transformation may be the Daubecies function, Harr function, Meyer function, Symlet function, or Coiflet function, for example.

As a result of the wavelet transformation multiresolution analysis, the number of resultant frequency components is preferably from 4 to 8, and more preferably 6.

In the first wavelet transformation, a one-dimensional data array is separated into plural frequency components. Another one-dimensional data array is created from the lowest-frequency component and is thinned. The thinned one-dimensional data array is subjected to the second wavelet transformation so as to be separated into plural frequency components.

The lowest-frequency component obtained in the first wavelet transformation is thinned so that the number of data arrays is reduced to from 1/10 to 1/100. In other words, the thinning factor is from 1/10 to 1/100.

Such a thinning treatment of data increases the frequency of data. For example, when a one-dimensional data array including 30,000 data arrays obtained in the first wavelet transformation is thinned so that the number of data arrays is reduced to 1/10, the thinned one-dimensional data array includes 3,000 data arrays.

When the thinning factor is less than 1/10, for example, 1/5, the frequency of data may not increase. In this case, the second wavelet transformation multiresolution analysis may result in insufficient data separation.

When the thinning factor is greater than 1/100, for example, 1/200, the frequency of data may increase too much. In this case, the second wavelet transformation multiresolution analysis may result in insufficient data separation such that the resulting frequency components concentrate at high frequencies.

Figure 9:
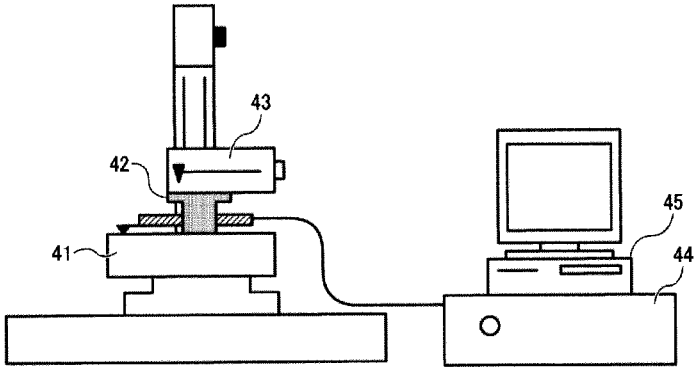
FIG. 9 is a schematic view illustrating an exemplary embodiment of a surface profile evaluating device.

FIG. 9 is a schematic view illustrating an example embodiment of a surface profile evaluating device. In FIG. 9, a numeral 41 denotes a photoreceptor, a numeral 42 denotes a jig equipped with a probe for measuring surface roughness, a numeral 43 denotes a unit for moving the jig 42 along a measuring object, a numeral 44 denotes a surface roughness and profile shape measuring instrument, and a numeral 45 denotes a personal computer for analyzing data signals. The personal computer 45 performs the multiresolution analysis. When the photoreceptor 41 has a cylindrical shape, the measurement can be performed both in the peripheral and longitudinal directions.

The embodiment of the surface profile evaluation device is not limited to that illustrated in FIG. 9. For example, the multiresolution analysis may be preformed by a numerical calculation processor. Alternatively, the multiresolution analysis may be performed by the surface roughness and profile shape measuring instrument itself.

The analysis results may be displayed on a CRT or a liquid crystal display or may be print-outputted. Alternatively, the analysis results may be transmitted to another device as electric signals or stored on a USB memory or a MO disc.

In the present embodiment, a surface texture and contour measuring instrument SURFCOM 1400D (from Tokyo Seimitsu Co., Ltd.) is used as the surface roughness and profile shape measuring instrument 44 and a personal computer from IBM is used as the personal computer 45, and the SURFCOM 1400D and the personal computer are connected with RS-232-C cable. Surface roughness data is transmitted from the SURFCOM 1400D to the personal computer and is subjected to data processing and multiresolution analysis using a software program written in C language by the inventors of the present invention.

The wavelet transformation is performed by a numerical analysis software program MATLAB. The definition of the frequency bandwidth has no specific meaning besides limitations arising from the software program. The factors vary according to the bandwidth. Each pairs of frequency bands HML and HLH, LHL and LMH, LMH and LML, LML and LLH, and LLH and LLL overlap with each other. The reason for this can be explained as follows. In the first wavelet transformation, an original signal is separated into low-frequency components (hereinafter "L components") and high-frequency components (hereinafter "H components"). Thereafter, the L components are further subjected to the wavelet transformation and separated into LL components and HL components. In a case where a frequency component f, which is included in the original signal, is also included in the separated frequency component F, the frequency component f becomes a boundary. It means that the frequency component f is included in both the L and H components. The occurrence of such a phenomenon is inevitable in multiresolution analyses. In order that a desired frequency band may not be separated by the wavelet transformation, an appropriate setting of the original signal to include appropriate frequency components is required. Alternatively, a signal which is separated into multiple frequency bands through multiple steps of the wavelet transformation can be restored into the original signal by the reverse wavelet transformation.

The procedure for the multiresolution analysis of a surface profile of a photoreceptor is described in detail below.

First, a primary profile of a photoreceptor is measured with a surface texture and contour measuring instrument SURFCOM 1400D (from Tokyo Seimitsu Co., Ltd.).

The evaluation length per measurement is 12 mm. The total number of sampling points is 30,720, and 4 sampling points are measured per measurement. The measurement results are transmitted to a personal computer and subjected to the first wavelet transformation with a software program written by the inventors. The lowest-frequency component is subjected to a thinning treatment with a thinning factor of 1/40, and then subjected to the second wavelet transformation.

Figure 10A:
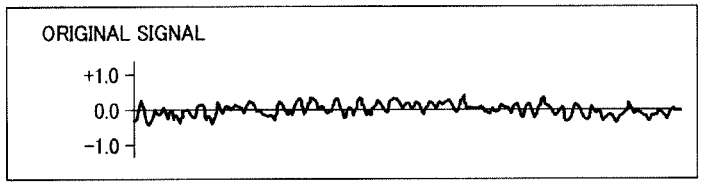
FIGS. 10A to 10C show exemplary results of the wavelet transformation multiresolution analysis.
Figure 10B:
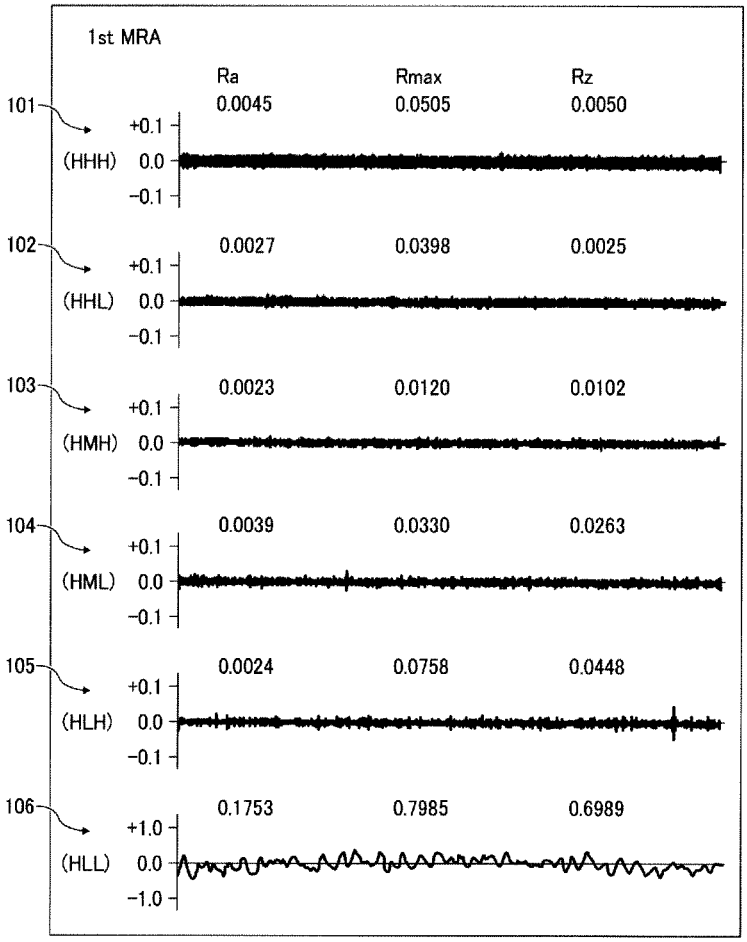
Figure 10C:
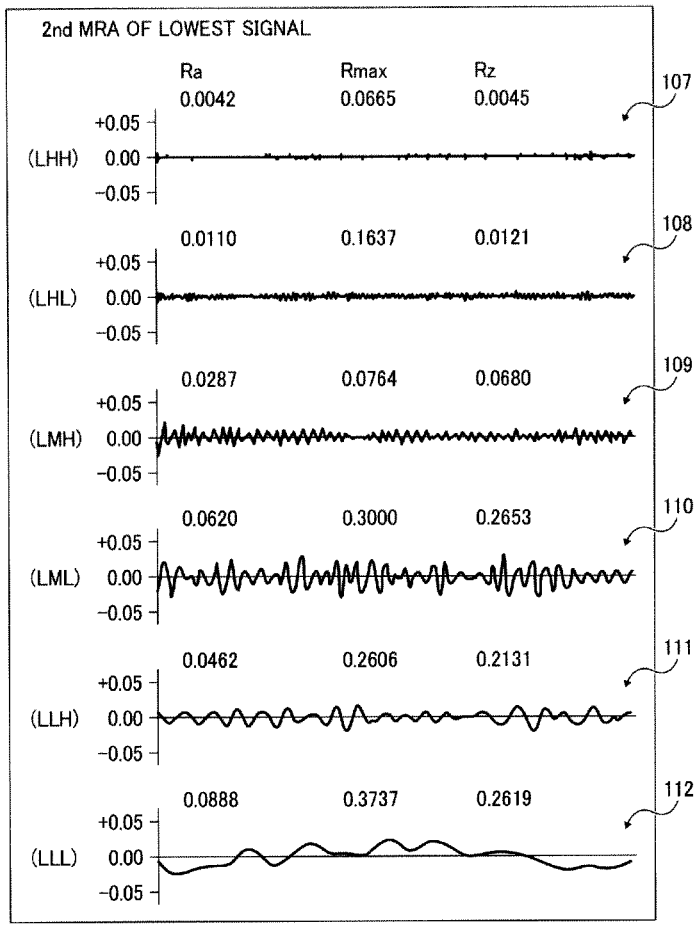

The resultant curves of the first and second multiresolution analysis are subjected to calculation of the arithmetic average roughness Ra, maximum height Rmax, and ten points average roughness Rz according to JIS B0601:2001. FIGS. 10A to 10C show example results of the wavelet transformation multiresolution analysis.

In FIGS. 10A to 10C, the vertical axes are displacement scales (μm) of surface profile. The lateral axes are evaluation length scales. In the present embodiment, the evaluation length is 12 mm.

FIG. 10A is a primary profile obtained with the SURFCOM 1400D. Conventionally, the arithmetic average roughness Ra, maximum height Rmax, and ten points average roughness Rz according to JIS B0601:2001 are calculated only from this primary profile.

FIG. 10B shows six frequency components obtained in the first multiresolution analysis. A curve 101 is the highest-frequency component and a curve 106 is the lowest-frequency component.

The curve 101 is the highest-frequency component having a cycle length of from 0 to 3 μm obtained in the first multiresolution analysis, which may be hereinafter represented as HHH.

The curve 102 is the second highest-frequency component having a cycle length of from 1 to 6 μm obtained in the first multiresolution analysis, which may be hereinafter represented as HHL.

The curve 103 is the third highest-frequency component having a cycle length of from 2 to 13 μm obtained in the first multiresolution analysis, which may be hereinafter represented as HMH.

The curve 104 is the fourth highest-frequency component having a cycle length of from 4 to 25 μm obtained in the first multiresolution analysis, which may be hereinafter represented as HML.

The curve 105 is the fifth highest-frequency component having a cycle length of from 10 to 50 μm obtained in the first multiresolution analysis, which may be hereinafter represented as HLH.

The curve 106 is the lowest-frequency component having a cycle length of from 24 to 99 μm obtained in the first multiresolution analysis, which may be hereinafter represented as HLL.

The primary profile illustrated in FIG. 10A is separated into 6 curves that are illustrated in FIG. 10B based on the frequency.

Figure 11:
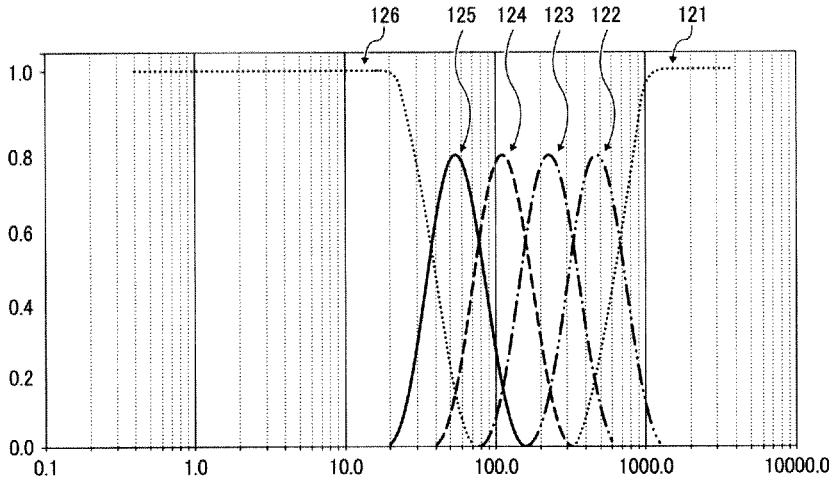
FIG. 11 is a graph showing frequency bands separated in the first multiresolution analysis.

FIG. 11 is a graph showing the frequency bands separated in the first multiresolution analysis. The lateral axis represents the number of irregularities per 1 mm when assuming a profile as a sine curve. The vertical axis represents the probability of each of the frequency bands.

In FIG. 11, a curve 121 is a band of the highest-frequency component in the first multiresolution analysis. A curve 122 is a band of the second highest-frequency component in the first multiresolution analysis. A curve 123 is a band of the third highest-frequency component in the first multiresolution analysis. A curve 124 is a band of the fourth highest-frequency component in the first multiresolution analysis. A curve 125 is a band of the fifth highest-frequency component in the first multiresolution analysis. A curve 126 is a band of the lowest-frequency component in the first multiresolution analysis.

FIG. 11 indicates that when the number of irregularities per 1 mm is 20 or less, the irregularities appear in the curve 126 only.

When the number of irregularities per 1 mm is 110, the irregularities most strongly appear in the curve 124 corresponding to the curve 104 (HML) in FIG. 10B.

When the number of irregularities per 1 mm is 220, the irregularities most strongly appear in the curve 123 corresponding to the curve 103 (HMH) in FIG. 10B.

When the number of irregularities per 1 mm is 310, the irregularities appear in the curves 122 and 123 corresponding to the curves 102 (HHL) and 103 (HMH), respectively, in FIG. 10B.

It depends on the frequency of the irregularities, in which curve in FIG. 10B the irregularities may appear.

In other words, relatively fine irregularities appear in the curves in the upper side of FIG. 10B while relatively coarse irregularities appear in the curves in the lower side of FIG. 10B.

Thus, a surface profile measured with a surface roughness and profile shape measuring instrument is separated into the plural curves 101 to 106 based on the frequency, as illustrated in FIG. 10B. Therefore, the number of irregularities in each frequency band can be separately measured.

The curves 101 to 106 can be further subjected to the calculation of the arithmetic average roughness Ra, maximum height, Rmax, and ten points average roughness Rz according to JIS B0601:2001. The calculated values thereof are also shown in FIG. 10B.

The lowest-frequency component, i.e., the curve 106 (FILL) is further subjected to a thinning treatment.

How to thin the curve, in other words, how many datum should be thinned in the thinning treatment may be experimentally optimized. The optimization of the thinning treatment may result in the optimization of the separation of frequency bands in the first multiresolution analysis so that a desired frequency appears in the center of a hand.

Figure 12:
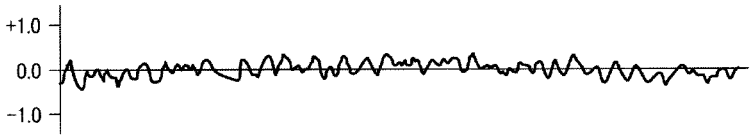
FIG. 12 is the result of the thinning treatment of the curve 106 (HLL) in FIG. 10B.

In the present embodiment, 1 datum is removed from 40 data in the thinning treatment. FIG. 12 is the result of the thinning treatment of the curve 106 (FILL) in FIG. 10B. The vertical axis is a displacement scale (μm) of a surface profile. The lateral axis is an evaluation length scale. In the present embodiment, the evaluation length is 12 mm.

The thinned curve 106 (FILL) shown in FIG. 12 is further subjected to the second multiresolution transformation.

FIG. 10C shows six frequency components obtained in the second multiresolution analysis.

A curve 107 is the highest-frequency component having a cycle length of from 26 to 106 μm obtained in the second multiresolution analysis, which may be hereinafter represented as LHH.

A curve 108 is the second highest-frequency component having a cycle length of from 53 to 183 μm obtained in the second multiresolution analysis, which may be hereinafter represented as LHL.

A curve 109 is the third highest-frequency component having a cycle length of from 106 to 318 μm obtained in the second multiresolution analysis, which may be hereinafter represented as LMH.

A curve 110 is the fourth highest-frequency component having a cycle length of from 214 to 551 μm obtained in the second multiresolution analysis, which may be hereinafter represented as LML.

A curve 111 is the fifth highest-frequency component having a cycle length of from 431 to 954 μm obtained in the second multiresolution analysis, which may be hereinafter represented as LLH.

A curve 112 is the lowest-frequency component having a cycle length of from 867 to 1654 μm obtained in the second multiresolution analysis, which may be hereinafter represented as LLL.

Figure 13:
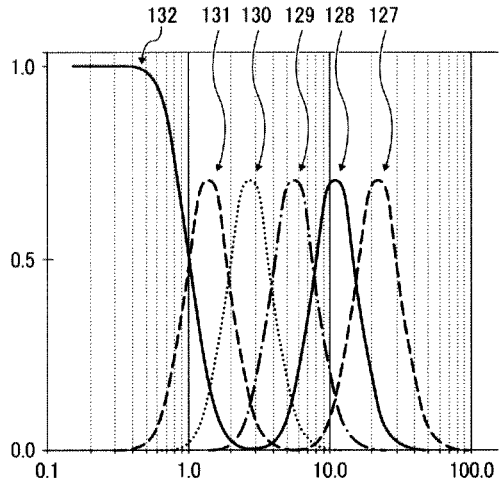
FIG. 13 is a graph showing frequency bands separated in the second multiresolution analysis.

FIG. 13 is a graph showing the frequency bands separated in the second multiresolution analysis. The lateral axis represents the number of irregularities per 1 mm when assuming a profile as a sine curve. The vertical axis represents the probability of each of the frequency bands.

In FIG. 13, a curve 127 is a band of the highest-frequency component in the second multiresolution analysis. A curve 128 is a band of the second highest-frequency component in the second multiresolution analysis. A curve 129 is a band of the third highest-frequency component in the second multiresolution analysis. A curve 130 is a band of the fourth highest-frequency component in the second multiresolution analysis. A curve 131 is a band of the fifth highest-frequency component in the second multiresolution analysis. A curve 132 is a band of the lowest-frequency component in the second multiresolution analysis.

FIG. 13 indicates that when the number of irregularities per 1 mm is 0.2 or less, the irregularities appear in the curve 132 only.

When the number of irregularities per 1 mm is 11, the irregularities most strongly appear in the curve 128 corresponding to the curve 110 (LML) in FIG. 10C.

It depends on the frequency of the irregularities, in which curve in FIG. 10C the irregularities may appear.

In other words, relatively fine irregularities appear in the curves in the upper side of FIG. 10C while relatively coarse irregularities appear in the curves in the lower side of FIG. 10C.

Thus, the curve 106 is separated into the plural curves 107 to 112 based on the frequency, as illustrated in FIG. 10C. Therefore, the number of irregularities in each frequency band can be separately measured.

The curves 107 to 112 are further subjected to the calculation of the arithmetic average roughness Ra (i.e., WRa), maximum height. Rmax, and ten points average roughness Rz according to JIS B0601:2001. The calculated values thereof are also shown in FIG. 10C.

The results of the above multiresolution analysis are shown in Table 1.

TABLE 1

| | | Surface Roughness (μm) | | |
|---|---|---|---|---|
| Multiresolution Analysis | Signals | Ra | Rmax | Rz |
| 1st | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| 2nd | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

Figure 14:
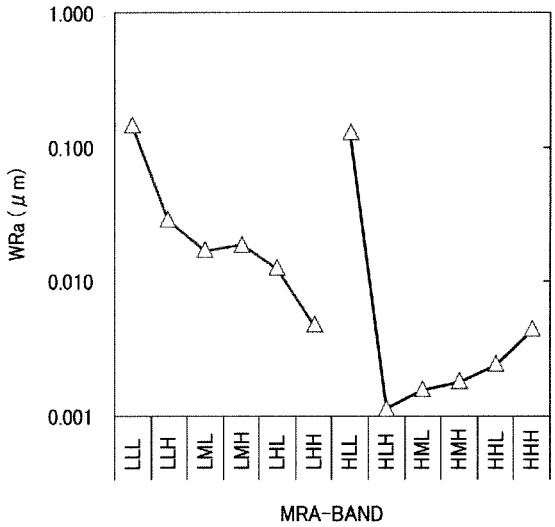
FIG. 14 is a graph showing the results of the wavelet transformation of the surface profile illustrated in FIG. 8.

FIG. 14 is a graph showing the results of the wavelet transformation of the surface profile illustrated in FIG. 8. (Such a graph is hereinafter referred to as "a roughness spectrum".) In FIG. 14, the roughness spectrum is substantially in a state of plateau within a band including LLH, LML, LMH, and LHL. Also, the roughness spectrum shows that WRa at HML, HML, HMH, HHL, and HHH are smaller than WRa at the plateau (i.e., LLH, LML, LMH, and LHL).

The inventors of the present invention found that when a photoreceptor has such a surface profile as illustrated in FIG. 8, in other words, a roughness spectrum as illustrated in FIG. 14, the surface has good receptivity to solid lubricants.

It is preferable that WRa is from 0.004 to 0.4 μm within the plateau. When WRa is too small, solid lubricants may not be evenly drawn on the surface of the photoreceptor with an application blade. When WRa is too large, toner particles may pass through the photoreceptor.

Accordingly, to improve solid lubricant receptivity, the photoreceptor preferably satisfies the following inequations:

$$0.01<WRa(LLH)<0.04 \quad (1\text{-}1)$$

$$0.01<WRa(LML)<0.04 \quad (1\text{-}2)$$

$$0.01<WRa(LMH)<0.04 \quad (1\text{-}3)$$

$$0.01<WRa(LHL)<0.04 \quad (1\text{-}4)$$

$$WRa(LHL)>WRa(LHH) \quad (2\text{-}1)$$

$$WRa(LHL)>WRa(HLH) \quad (2\text{-}2)$$

$$WRa(LHL)>WRa(HML) \quad (2\text{-}3)$$

$$WRa(LHL)>WRa(HMH) \quad (2\text{-}4)$$

$$WRa(LHL)>WRa(HHL) \quad (2\text{-}5)$$

$$WRa(LHL)>WRa(HHH) \quad (2\text{-}6).$$

WRa (μm) represents an arithmetic average roughness according to JIS-B0601:2001 of frequency components that are obtained by:

subjecting a one-dimensional data array of a surface profile of the electrophotographic photoreceptor, measured with a surface roughness and profile shape measuring instrument, to a wavelet transformation multiresolution analysis so as to be separated into six frequency components, HHH, HHL, HMH, HML, HLH, and HLL, each having a cycle length (μm) of 0 to 3, 1 to 6, 2 to 13, 4 to 25, 10 to 50, and 24 to 99, respectively;

thinning a one-dimensional data array of the lowest frequency component HHL having a cycle length of from 24 to 99 (μm) so that the number of data arrays is reduced to from 1/10 to 1/100; and subjecting the thinned one-dimensional data array to the wavelet transformation multiresolution analysis so as to be separated into six frequency components, LHH, LHL, LMH, LML, LLH, and LLL, each having a cycle length (μm) of 26 to 106, 53 to 183, 106 to 318, 214 to 551, 431 to 954, and 867 to 1,654, respectively.

Next, exemplary embodiments of the electrophotographic photoreceptor according to this specification are described in detail.

Figure 15:
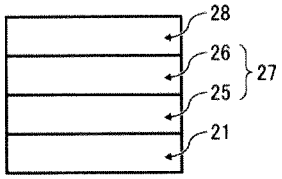
FIG. 15 is a schematic view illustrating an embodiment of the photoreceptor of the present invention.

FIG. 15 is a schematic view illustrating an embodiment of the photoreceptor which includes, in order from an innermost side thereof, a conductive substrate 21, a photosensitive layer 27 including a charge generation layer 25 and a charge transport layer 26, and a cross-linked resin surface layer 28.

Figure 16:
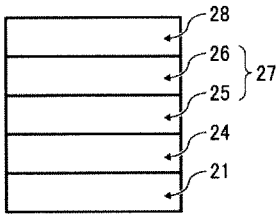
FIG. 16 is a schematic view illustrating another embodiment of the photoreceptor of the present invention.

FIG. 16 is a schematic view illustrating another embodiment of the photoreceptor which includes, in order from an innermost side thereof, a conductive substrate 21, an undercoat layer 24, a photosensitive layer 27 including a charge generation layer 25 and a charge transport layer 26, and a cross-linked resin surface layer 28.

Suitable materials for the conductive substrate 21 include material having a volume resistivity not greater than $10^{10}\Omega\cdot$cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate 21, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments.

The undercoat layer 24 may be provided between the conductive substrate 21 and the photosensitive layer 27, as illustrated in FIG. 16, for the purpose of improving adhesion and coating properties of the upper layer and preventing the occurrence of moiré and charge injection from the conductive substrate 21.

The undercoat layer 24 is comprised primarily of a resin. Because the photosensitive layer 27 is coated on the undercoat layer 24, the undercoat layer 24 preferably comprises a thermosetting resin, which has poor solubility in organic solvents. Specific preferred examples of such resins include, but are not limited to, polyurethane resins, melamine resins, and alkyd-melamine resins. The undercoat layer 24 may be formed by coating a coating liquid in which a resin is dissolved in a solvent such as tetrahydrofuran, cyclohexane, dioxane, dichloroethane, and butanone.

The undercoat layer 24 may include fine particles of a metal or a metal oxide for the purpose of controlling conductivity and preventing the occurrence of moiré. Specifically, titanium oxides are preferable.

The fine particles may be subjected to a dispersion treatment using a ball mill, an attritor, a sand mill, or the like, with a solvent such as tetrahydrofuran, cyclohexanone, dioxane, dichloroethane, and butanone, and then mixed with a resin to prepare a coating liquid.

The undercoat layer 24 is formed by applying the coating liquid to the conductive substrate 21 by a dip coating method, a spray coating method, a bead coating method, or the like, upon application of heating, if needed.

The undercoat layer 24 generally has a thickness of from 2 to 5 μm, and preferably less than 3 μm to reduce residual potential.

The photosensitive layer 27 may be a multilayer including the charge generation layer 25 and the charge transport layer 26.

The charge generation layer 25 has a function of generating charge upon exposure to light. The charge generation layer 25 includes a charge generation material as the main component and may include a binder resin, if needed. Suitable charge generation materials include both inorganic materials and organic materials.

Specific examples of usable inorganic materials for the charge generation material include, but are not limited to, crystalline selenium, amorphous selenium, selenium-tellurium, selenium-tellurium-halogen, selenium-arsenic compounds, and amorphous silicon. An amorphous silicon in which dangling bonds are terminated with a hydrogen or halogen atom and an amorphous silicon doped with a boron or phosphor atom are also preferable.

Specific examples of usable organic materials for the charge generation material include, but are not limited to, metal phthalocyanines such as titanyl phthalocyanine and chlorogallium phthalocyanine; metal-free phthalocyanines; azulenium salt pigments; squaric acid methine pigments; symmetric or asymmetric azo pigments having a carbazole skeleton; symmetric or asymmetric azo pigments having a triphenylamine skeleton; symmetric or asymmetric azo pigments having a fluorenone skeleton; and perylene pigments. Among these materials, metal phthalocyanines, symmetric or asymmetric azo pigments having a fluorenone skeleton, symmetric or asymmetric azo pigments having a triphenylamine skeleton, and perylene pigments are preferable because they have a high charge generation quantum efficiency. These materials can be used alone or in combination.

Specific examples of usable binder resins for the charge generation layer 25 include, but are not limited to, polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, and polyacrylamide. Additionally, charge transport polymers, to be described in detail later, are also usable as the binder resin. Among these resins, polyvinyl butyral is preferable. These resins can be used alone or in combination.

The charge generation layer 25 may be formed by a vacuum method or a casting method.

The former includes a vacuum deposition method, a glow discharge decomposition method, an ion plating method, a sputtering method, a reactive sputtering method, and a CVD (chemical vapor deposition) method, for example. These methods can form a layer comprising the above-described inorganic or organic material in good condition.

In the latter, first, the above-described inorganic or organic material, optionally along with a binder resin, is dispersed in a solvent such as methyl ethyl ketone, tetrahydrofuran, cyclohexanone, dioxane, dichloroethane, and butanone, using a ball mill, an attritor, a sand mill, or the like. The resultant dispersion may be diluted as appropriate. Among these solvents, methyl ethyl ketone, tetrahydrofuran, and cyclohexanone are more preferable compared to chlorobenzene, dichloromethane, toluene, or xylene, because of being environmentally-friendly. The dispersion is coated by a dip coating method, a spray coating method, a bead coating method, or the like.

The charge generation layer 25 preferably has a thickness of from 0.01 to 5 μm. Reduction of residual potential and increase of sensitivity may be achieved by thickening the charge generation layer 25. At the same time, deterioration of chargeability (such as charge retention ability and formation of space charge) is caused by thickening of the charge generation layer 25. To balance these properties, the charge generation layer 25 more preferably has a thickness of from 0.05 to 2 μm.

The charge generation layer 25 may optionally include a low-molecular-weight compound such as an antioxidant, a plasticizer, a lubricant, and an ultraviolet absorber, and/or a leveling agent. These compounds can be used alone or in combination. Because too large an amount of a low-molecular-weight compound and/or a leveling agent may cause deterioration of sensitivity, the content thereof in the charge generation layer 25 is preferably from 0.1 to 20 parts by weight, more preferably from 0.1 to 10 parts by weight, and most preferably from 0.001 to 0.1 parts by weight, based on 100 parts by weight of resins.

The charge transport layer 26 has a function of transporting charges generated in the charge generation layer 25 so as to neutralize charges on the surface of the photoreceptor. The charge transport layer 26 is comprised primarily of a charge transport material and a binder resin.

Charge transport materials include low-molecular-weight electron transport materials, hole transport materials, and charge transport polymers.

Specific examples of usable electron transport materials include, but are not limited to, electron accepting materials such as asymmetric diphenoquinone derivatives, fluorene derivatives, and naphthalimide derivatives. These electron transport materials can be used alone or in combination.

Specific examples of usable hole transport materials include, but are not limited to, electron releasing materials such as oxazole derivatives, oxadiazole derivatives, imidazole derivatives, triphenylamine derivatives, butadiene derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These hole transport materials can be used alone or in combination.

Specific examples of usable charge transport polymers include, but are not limited to, polymers having a carbazole ring such as poly-N-vinylcarbazole; polymers having a hydrazone structure described in JP-57-78402-A, the disclosure thereof being incorporated herein by reference; polysilylene polymers described in JP-63-285552-A, the disclosure thereof being incorporated herein by reference; and aromatic polycarbonates represented by the general formulae (1) to (6) in JP-2001-330973-A, the disclosure thereof being incorporated herein by reference. These charge transport polymers can be used alone or in combination. Among these compounds, aromatic polycarbonates described in JP-2001-330973-A are preferable because of having good electrostatic properties.

Compared to low-molecular-weight charge transport materials, charge transport polymers are more advantageous because they can prevent migration of materials composing the charge transport layer 26 to the cross-linked resin surface layer 28, which may cause insufficient hardening of the cross-linked resin surface layer. Additionally, because charge transport polymers (i.e., high-molecular-weight charge transport materials) have excellent heat resistance, the charge transport layer 26 is unlikely to deteriorate due to hardening heat of the cross-linked resin surface layer 28.

Specific examples of usable binder resins for the charge transport layer 26 include, but are not limited to, thermoplastic and thermosetting resins such as polystyrene, polyester, polyvinyl, polyarylate, polycarbonate, acrylic resins, silicone resins, fluorocarbon resins, epoxy resins, melamine resins, urethane resins, phenol resins, and alkyd resins. Among these materials, polystyrene, polyester, polyarylate, and polycarbonate are preferable because of having excellent charge transportability. The charge transport layer 26 is not required to have mechanical strength because the cross-linked resin surface layer 28 is provided thereon. Therefore, materials with high transparency and low mechanical strength, such as polystyrene, which have not been practically used, can also be used as the binder resin for the charge transport layer 26.

The above-described binder resins can be used alone or in combination. Alternatively, 2 or more monomers of the binder resins may be copolymerized with each other, or further copolymerized with a charge transport material.

Electrically-inactive polymers which include no photoconductive chemical structure (e.g., a triarylamine structure) may be added to the charge transport layer 26 for its reformulation. For example, the following compounds are usable: Cardo polyesters having a bulky skeleton such as a fluorene skeleton; polyesters such as polyethylene terephthalate and polyethylene naphthalate; polycarbonates in which the 3,3' position of the phenol composition of a bisphenol-type polycarbonate is substituted with an alkyl group (e.g., C-type poly carbonates); polycarbonates in which a geminal methyl group of bisphenol A is substituted with a long-chain alkyl group having 2 or more carbon atoms; polycarbonates having a biphenyl or biphenyl ether skeleton; polycaprolactones; polycarbonates having a long-chain alkyl skeleton similar to a polycaprolactone, described in JP-A 07-292095, the disclosure thereof being incorporated herein by reference; acrylic resin; polystyrenes; and hydrogenated butadienes.

When the above compounds are used in combination with the binder resins, the content thereof in the charge transport layer 26 is preferably 50% or less by weight based on solid contents so as not to deteriorate sensitivity to light attenuation.

When the charge transport layer 26 includes a low-molecular-weight charge transport material, the content thereof is preferably from 40 to 200 parts by weight, more preferably from 70 to 100 parts by weight, based on 100 parts by weight of resins.

When the charge transport layer 26 includes a charge transport polymer (i.e., a high-molecular-weight charge transport material), the charge transport polymer is preferably a copolymer in which 100 parts by weight of a charge transport component and 0 to 200 parts by weight, more preferably from 80 to 150 parts by weight, of a resin component are copolymerized.

When the charge transport layer 26 includes 2 or more charge transport materials, the difference among the charge transport materials in ionization potential is preferably as small as possible. More specifically, the difference in ionization potential is preferably 0.10 eV or less. Within such a range, one charge transport material is prevented from trapping other transport materials.

Similarly, when the charge transport layer 26 includes a charge transport material and a curable charge transport material, to be described in detail later, the difference in ionization potential is preferably 0.10 eV or less.

The ionization potential of charge transport materials can be measured with an atmospheric photoemission yield spectroscopic instrument AC-1 from Riken Keiki Co., Ltd.

To achieve high sensitivity, the charge transport layer 26 preferably includes a charge transport material in an amount of 70 parts or more by weight based on 100 parts by weight of resins. In particular, monomers and dimers of α-phenylstilbene compounds, benzidine compounds, and butadiene compounds, and charge transport polymers having a main chain or a side chain with the structure of the above monomers and dimers, are preferable for the charge transport material because of having high charge transportability.

Specific examples of usable solvents for coating the charge transport layer 26 include, but are not limited to, ketones (e.g., methyl ethyl ketone, acetone, methyl isobutyl ketone, cyclohexanone); ethers (e.g., dioxane, tetrahydrofuran, ethyl cellosolve); aromatic solvents (e.g., toluene, xylene); halogen-containing solvents (e.g., chlorobenzene, dichloromethane); and esters (e.g., ethyl acetate, butyl acetate). Among these solvents, methyl ethyl ketone, tetrahydrofuran, and cyclohexanone are preferable because the are more environmentally friendly compared to chlorobenzene, dichloromethane, toluene, and xylene. These solvents can be used alone or in combination.

The charge transport layer 26 may be formed by coating a coating liquid in which a mixture or a copolymer comprised primarily of a charge transport material and a binder resin is dissolved or dispersed in the above-described solvent, followed by drying. The coating liquid may be coated by a dip coating method, a spray coating method, a ring coating method, a roll coater method, a gravure coating method, a nozzle coating method, or a screen printing method, for example.

Because the cross-linked resin surface layer 28 is provided on the charge transport layer 26, the charge transport layer 26 may not be abraded. Therefore, it is not necessary to thicken the charge transport layer 26.

Accordingly, the charge transport layer 26 preferably has a thickness of from 10 to 40 μm, and more preferably from 15 to 30 μm, to have satisfactory sensitivity and chargeability.

The charge transport layer 26 may optionally include a low-molecular-weight compound such as an antioxidant, a plasticizer, a lubricant, and an ultraviolet absorber, and/or a leveling agent. These compounds can be used alone or in combination. Because too large an amount of a low-molecular-weight compound and/or a leveling agent may cause deterioration of sensitivity, the content thereof in the charge transport layer 26 is preferably from 0.1 to 20 parts by weight, more preferably from 0.1 to 10 parts by weight, and most preferably from 0.001 to 0.1 parts by weight, based on 100 parts by weight of resins.

The charge transport layer 26 preferably satisfies the following inequations, so that the cross-linked resin surface layer 28 to be formed thereon has a surface profile which provides good receptivity to solid lubricants:

$$0.01 < WRa(LLH) < 0.07 \quad (3\text{-}1)$$

$$0.01 < WRa(LML) < 0.07 \quad (3\text{-}2)$$

$$0.01 < WRa(LMH) < 0.07 \quad (3\text{-}3)$$

$$0.01 < WRa(LHL) < 0.07 \quad (3\text{-}4)$$

The inequations (3-1) to (3-4) are achieved by spraying an organic solvent on the surface of the charge transport layer 26 to dissolve a part thereof. Subsequently, a coating liquid for the cross-linked resin surface layer 28 is sprayed thereon. Thus, the resulting cross-linked resin surface layer 28 can satisfy the inquations (1-1) to (1-4) and 1 to (2-6).

When the organic solvent is sprayed on the charge transport layer 26, the photoreceptor is preferably rotated at a revolution of from 80 to 200 rpm.

When the revolution is too small, the charge transport layer 26 may be excessively dissolved by the organic solvent. When the revolution is too large, gentle irregularities, which can spread solid lubricants over the photoreceptor, may not be formed.

The cross-linked resin surface layer 28 is a layer for protecting the surface of the photoreceptor. The cross-linked resin surface layer 28 is formed by coating a coating liquid, upon which a polymerization reaction takes place to form a resin having a cross-linked structure (hereinafter "cross-linked resin"). Such a cross-linked resin has high abrasion resistance.

The cross-linked resin is formed from a cross-linkable charge transport material. Therefore, the cross-linked resin surface layer 28 has a similar charge transportability to the charge transport layer 26.

Specific examples of usable cross-linkable charge transport materials include, but are not limited to, chain-growth-polymerizable compounds having an acryloyloxy or styrene group; and step-growth-polymerizable compounds having a hydroxyl, alkoxysilyl, or isocyanate group. Further, compounds having a charge transport structure and 1 or more methacryloyloxy or acryloyloxy groups are also usable. Such compounds may be optionally used in combination with monomers or oligomers having no charge transport structure and 1 or more methacryloyloxy or acryloyloxy groups. These cross-linkable materials are included in the surface layer coating liquid and cross-linked upon application of heat, light, or radial ray. The surface layer coating liquid including such a cross-linkable charge transport material is subjected to cross-linking and curing reactions upon application of energy such as heat, light, or radial ray such as electron beam and γ ray.

The following compound (A) is one preferred example for the cross-linkable charge transport material:

(A)

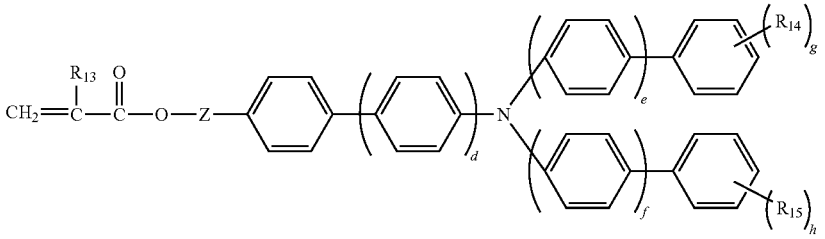

wherein each of d, e, and f independently represents an integer of 0 or 1; each of g and h independently represents an integer of from 0 to 3; $R_{13}$ represents a hydrogen atom or a methyl group; each of $R_{14}$ and $R_{15}$ independently represents an alkyl group having 1 to 6 carbon atoms, wherein multiple $R_{14}$ and $R_{15}$ may be, but need not necessarily be, the same; and Z represents a single bond, a methylene group, an ethylene group, —$CH_2CH_2O$—,

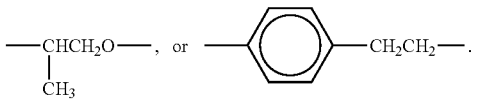

The following compounds No. 1 to No. 26 are also preferred examples for the cross-linkable charge transport material.

No. 1

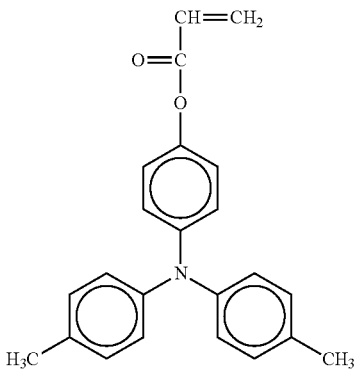

-continued
No. 2
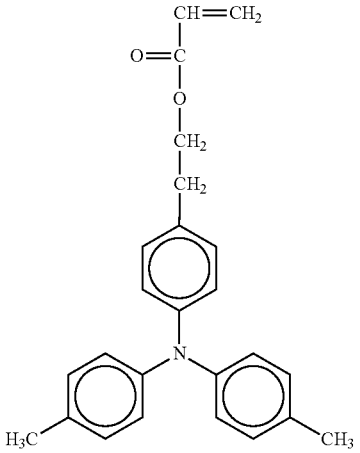
No. 3
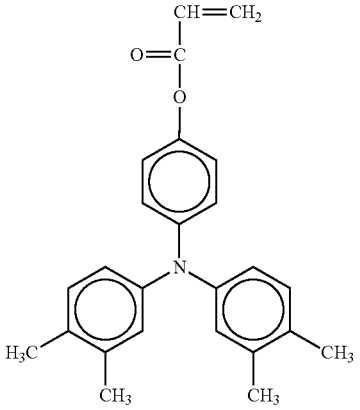
No. 4
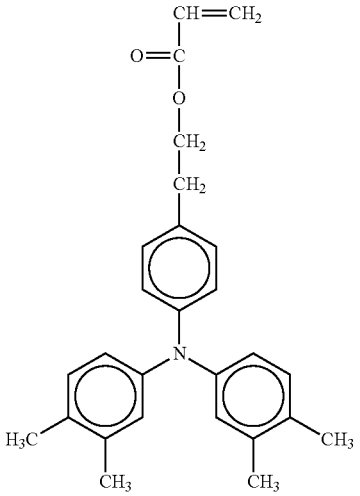
-continued
No. 5
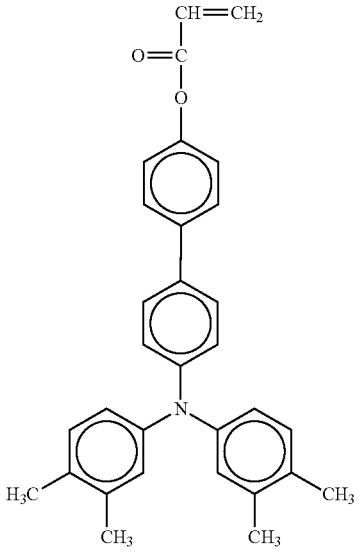
No. 6
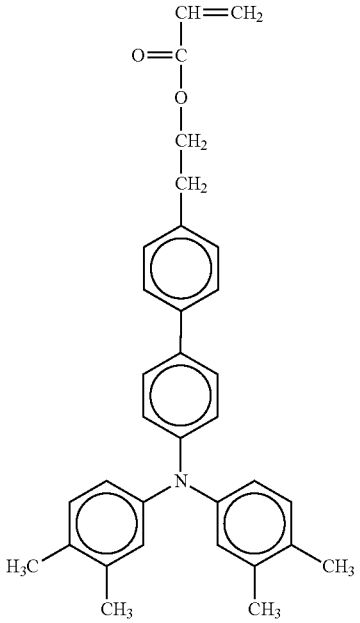

-continued
No. 7
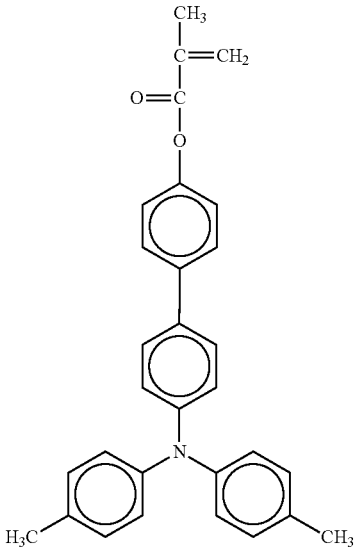
No. 8
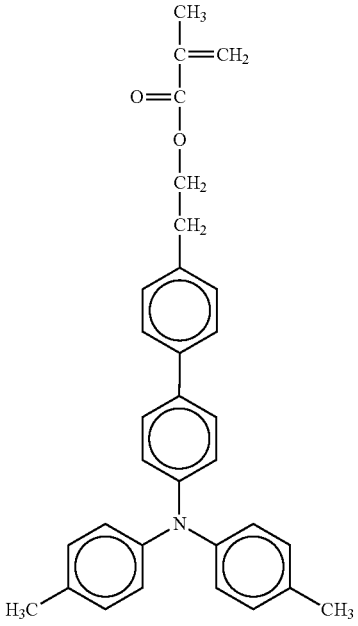
-continued
No. 9
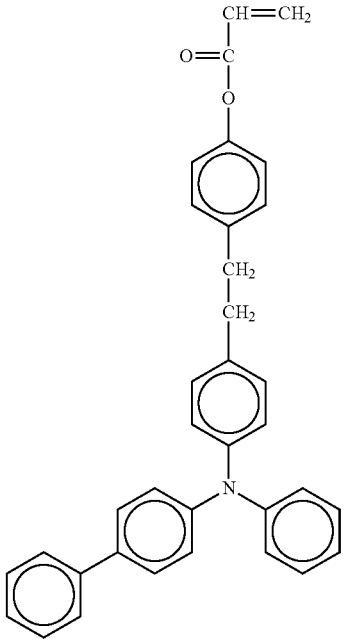
No. 10
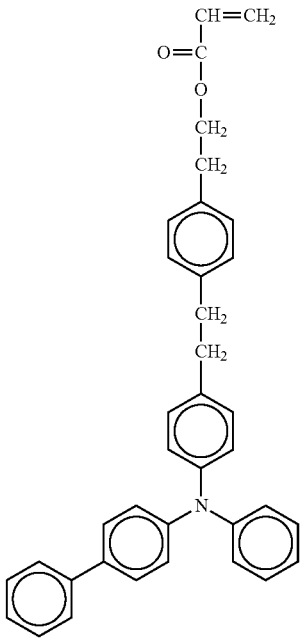

-continued
No. 11
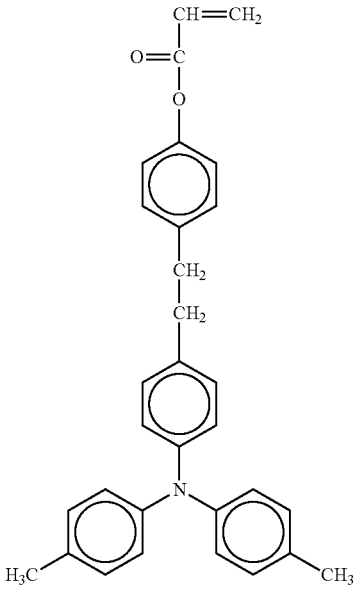
No. 12
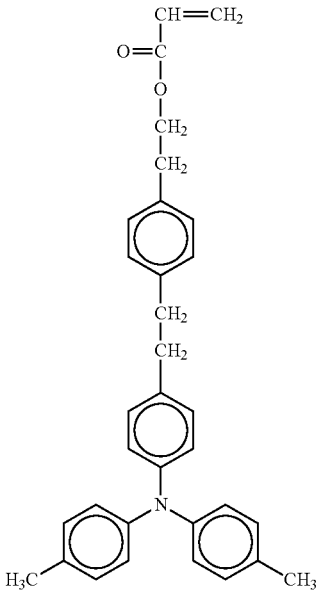
-continued
No. 13
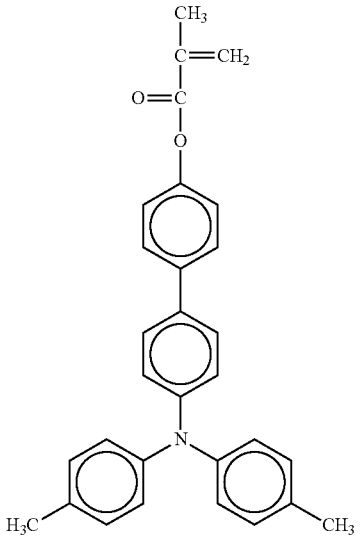
No. 14
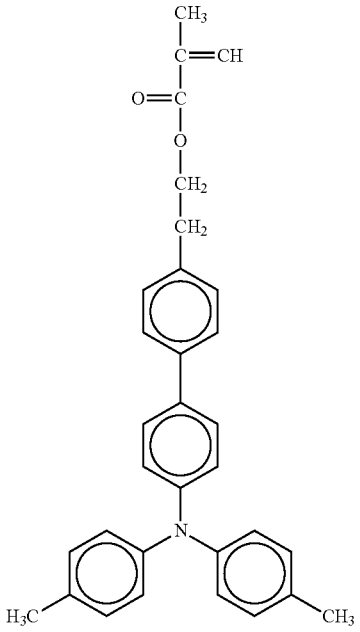

-continued
No. 15
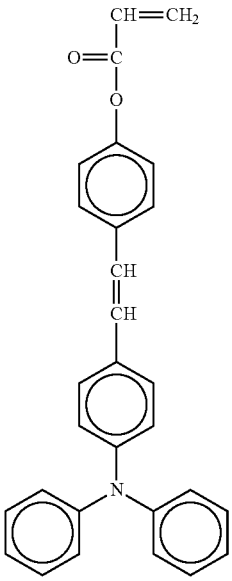
No. 16
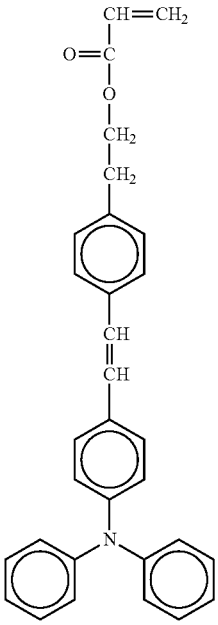
-continued
No. 17
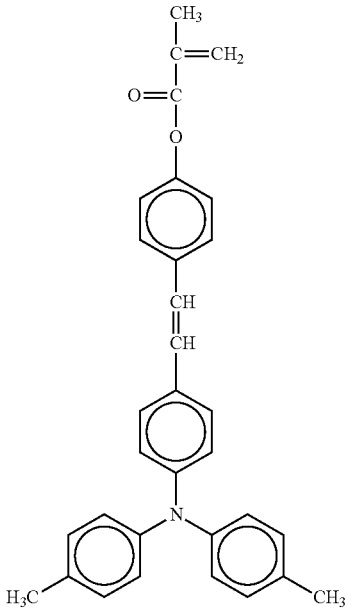
No. 18
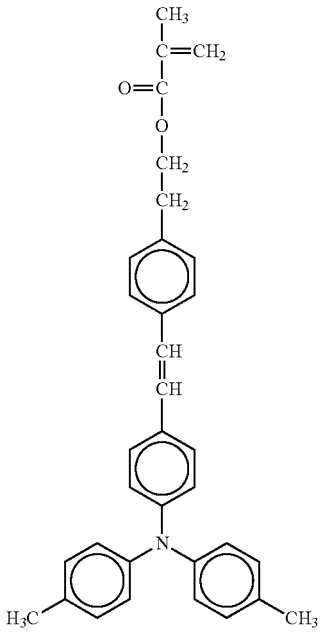

-continued
No. 19
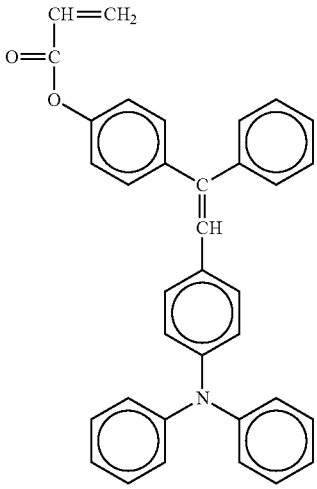
No. 20
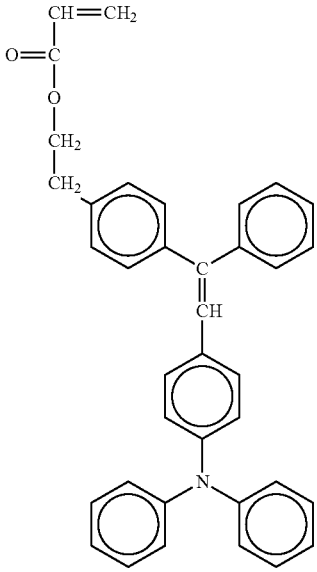
No. 21
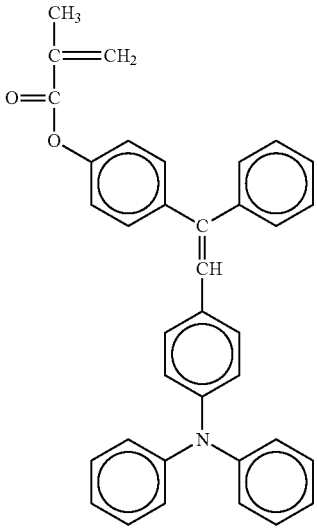
-continued
No. 22
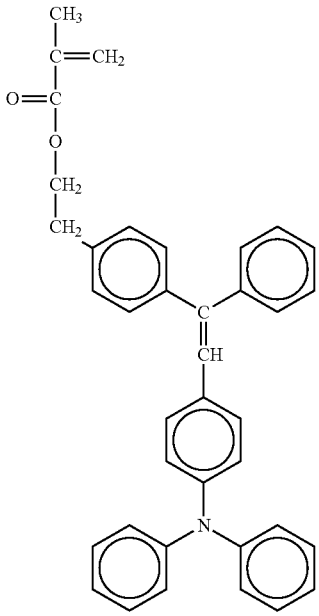
No. 23
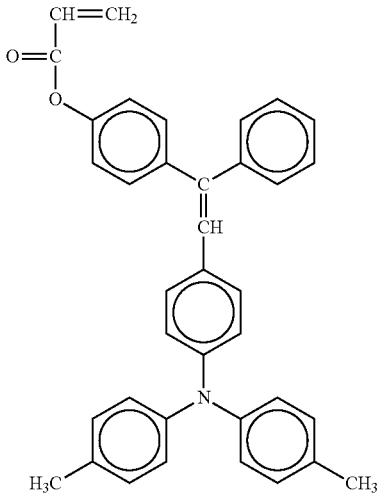

-continued

No. 24

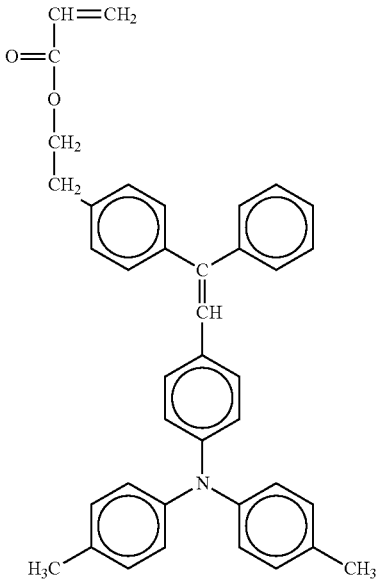

No. 25

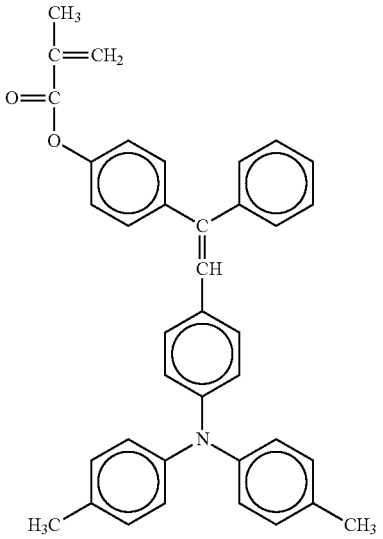

-continued

No. 26

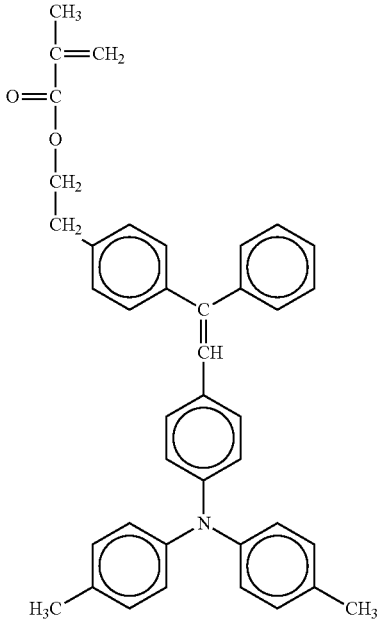

To improve abrasion resistance and stiffness of the cross-linked resin surface layer 28, a radical-polymerizable monomer having 3 or more radical-polymerizable functional groups, such as a caprolactone-modified dipentaerythritol hexaacrylate and a dipentaerythritol hexaacrylate, are preferably used in combination with the above-described charge transport material.

Additionally, a radical-polymerizable monomer having 3 or more functional groups without charge transport structure is also usable. Specific examples of such monomers include, but are not limited to, trimethylolpropane triacrylate, caprolactone-modified dipentaerythritol hexaacrylate, and dipentaerythritol hexaacrylate.

These materials are available from Tokyo Chemical Industry Co., Ltd., or Nippon Kayaku Co., Ltd. under the trade name of KAYARD DPCA series and KAYARD DPHA series.

To accelerate or stabilize the curing reaction, an initiator such as IRGACURE® 184 (from Ciba) in an amount of from 5 to 10% by weight (based on solid contents) may be added to the cross-linked resin surface layer 28.

The cross-linked resin surface layer 28 is preferably formed by coating the photosensitive layer 27 with a coating liquid and curing the coating liquid.

Specific examples of usable solvents for preparing the coating liquid for the cross-linked resin surface layer 28 include, but are not limited to, ethers (e.g., dioxane, tetrahydrofuran, ethyl cellosolve); aromatic solvents (e.g., toluene, xylene); halogen-containing solvents (e.g., chlorobenzene, dichloromethane); esters (e.g., ethyl acetate, butyl acetate); cellosolves (e.g., ethoxyethanol); and propylene glycols (e.g., 1-methoxy-2-propanol). In particular, methyl ethyl ketone, tetrahydrofuran, cyclohexanone, and 1-methoxy-2-propanol are preferable because they can dissolve the charge transport layer 26, and more environmentally-friendly compared to chlorobenzene, dichloromethane, toluene, or xylene, because of being. These solvents can be used alone or in combination.

The coating liquid of the cross-linked resin surface layer 28 may be coated by a dip coating method, a spray coating method, a ring coating method, a roll coater method, a gravure coating method, a nozzle coating method, or a screen printing method, for example. Because coating liquids generally have a relatively short pot life, methods capable of coating with a small amount of the coating liquid are advantages from the viewpoint of environmental consciousness and cost. Among the above coating methods, a spray coating method and a ring coating method are preferable.

When forming the cross-linked resin surface layer 28, UV emitting light sources having the emission wavelength in the ultraviolet region, such as high-pressure mercury lamps and metal halide lamps, are usable. Additionally, visible light emitting light sources are also usable, depending on the absorption wavelength of radical-polymerizable compounds, photopolymerization initiators, etc. The amount of emission light is preferably from 50 to 1,000 mW/cm$^2$. When the amount emission light is too small, it takes too long a time for the curing reaction. When the amount of emission light is too large, the curing reaction may proceed unevenly, generating local wrinkles on the cross-linked resin surface layer and/or a lot of residual groups which have not been reacted and terminal ends which have lost reactivity. Additionally, the cross-linking reaction may proceed so quickly that the inner stress may increase, thereby causing cracks and peeling of the layer.

The cross-linked resin surface layer 28 may optionally include a low-molecular-weight compound such as an anti-oxidant, a plasticizer, a lubricant, and an ultraviolet absorber, and/or a leveling agent. Also, the cross-linked resin surface layer 28 may optionally include the above-described polymer compounds usable for the charge transport layer 26. These compounds can be used alone or in combination. Because too large an amount of a low-molecular-weight compound and/or a leveling agent may cause deterioration of sensitivity, the content thereof in the cross-linked resin surface layer is preferably from 0.1 to 20% by weight, and more preferably from 0.1 to 10% by weight. In particular, the content of a leveling agent is preferably from 0.1 to 5% by weight.

The cross-linked resin surface layer 28 preferably has a thickness of from 3 to 15 μm. When the thickness is too small, the cross-linked resin surface layer 28 cannot satisfactorily protect the photoreceptor. When the thickness is too large, the surface profile of the charge transport layer 26 cannot be translated into that of the cross-linked resin surface layer 28. Besides, electrostatic properties (e.g., charging stability, light attenuation sensitivity) may deteriorate.

The surface of the photoreceptor can be roughened by the following methods. For example, one specific method of roughening the surface of the photoreceptor includes adding materials capable of controlling the surface profile to the cross-linked resin surface layer 28. Specific examples of such materials include fillers, zol-gel coating materials, polymer blends comprising various resins with different glass transition points, organic fine particles, foaming agents, and a large amount of silicone oil. Another specific method includes controlling layer forming conditions by adding a large amount of water or liquid materials having different boiling points to the coating liquid of the cross-linked resin surface layer 28. Yet another specific method includes spraying an organic solvent or water on a wet layer that is formed immediately after coating the coating liquid and is not yet subjected to curing. Alternatively, the cross-linked resin surface layer 28 may be subjected to a sandblast treatment or a surface abrasion treatment using an abrasion paper such as a lapping film after curing.

Because the inequations (1-1) to (1-4) and (2-1) to (2-6) are not always achieved simultaneously by each of the above-described treatments, two or more of the above-described methods can be combined, if needed. Alternatively, the inequations (1-1) to (1-4) and (2-1) to (2-6) can be achieved by spraying an organic solvent on the photosensitive layer before spray-coating the cross-linked surface layer 28 thereon.

Next, exemplary embodiments of the image forming apparatus according to this specification are described in detail. The image forming apparatus comprises an image forming unit and a solid lubricant applicator. For the sake of simplicity, the image forming unit and the solid lubricant applicator will be described separately.

First, exemplary embodiments of the image forming unit are described in detail. For the sake of simplicity, the same reference number will be given to identical constituent elements such as parts and materials having the same functions and redundant descriptions thereof omitted unless otherwise stated.

Figure 17:
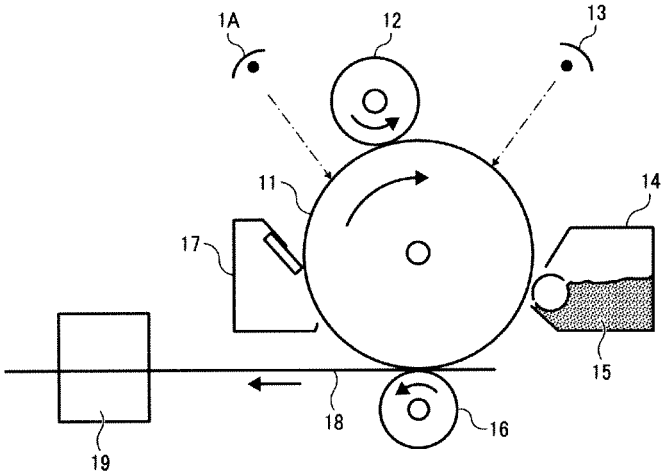
FIG. 17 is a schematic view illustrating an embodiment of the image forming unit according to this specification.

FIG. 17 is a schematic view illustrating an embodiment of the image forming unit.

A photoreceptor 11 is the photoreceptor according to this specification, having the cross-linked resin surface layer satisfying the inequations (1-1) to (1-4) and (2-1) to (2-6). The photoreceptor 11 is in the form of a drum in FIG. 17. Alternatively, the photoreceptor 11 may be in the form of a sheet or an endless belt.

A charger 12 may be a corotron, a scorotron, a solid state charger, or a charging roller, for example. From the viewpoint of consumption energy saving, the charger 12 is preferably provided in contact with or proximally to the photoreceptor 11. To prevent contamination of the charger 12, it is more preferable to provide the charger 12 proximally to the photoreceptor 11 so that a reasonable gap is formed between the photoreceptor 11 and the charger 12.

A transferrer 16 may also be a corotron, a scorotron, a solid state charger, or a charging roller, for example. Preferably, the transferrer 16 may be a combination of a transfer charger and a separation charger.

An irradiator 13 and a neutralizer 1A each may be a light source such as a fluorescent lamp, a tungsten lamp, a halogen lamp, a mercury lamp, a sodium lamp, a light-emitting diode (LED), a laser diode (LD), and an electroluminescence (EL). To emit light having a desired wavelength, these light sources can be equipped with a filter such as a sharp cut filter, a bandpass filter, a near-infrared cut filter, a dichroic filter, an interference filter, and a color temperature conversion filter.

A developing device 14 develops a latent image on the photoreceptor 11 with a toner 15. The toner 15 is transferred from the photoreceptor 11 onto a recording medium 18 such as a printing paper and an OHP sheet. The toner 15 is then fixed on the recording medium 18 in a fixing device 19. Some toner particles may remain on the photoreceptor 11 without being transferred onto the recording medium 18. Such residual toner particles are removed from the photoreceptor 11 with a cleaner 17. The cleaner 17 may be, for example, a rubber blade, a fur brush, or a magnetic fur brush.

When the photoreceptor 11 is positively (or negatively) charged and irradiated with light containing image information, a positive (or negative) electrostatic latent image is formed thereon. When the positive (or negative) electrostatic latent image is developed with a negatively-charged (or positively-charged) toner, a positive image is obtained. By contrast, when the positive (or negative) electrostatic latent image is developed with a positively-charged (or negatively-charged) toner, a negative image is obtained.

Figure 18:
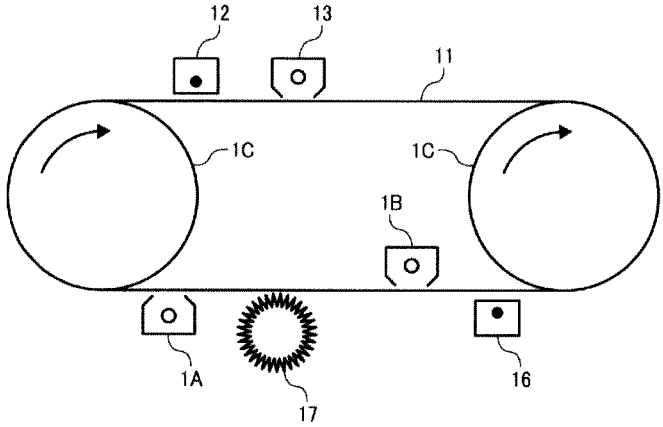
FIG. 18 is a schematic view illustrating another embodiment of the image forming unit according to this specification.

FIG. 18 is a schematic view illustrating another embodiment of the image forming unit.

A photoreceptor 11 is the photoreceptor according to this specification, having the cross-linked resin surface layer satisfying the inequations (1-1) to (1-4) and (2-1) to (2-6). The photoreceptor 11 is in the form of a belt in FIG. 18. Alternatively, the photoreceptor 11 may be in the form of a drum or an endless belt.

The photoreceptor 11 is driven by driving members 1C and repeatedly subjected to the processes of charging with a charger 12, image irradiation with an image irradiator 13, development with a developing device (not shown), transfer with a transferrer 16, pre-cleaning irradiation with a pre-cleaning irradiator 1B, cleaning with a cleaner 17, and neutralization with a neutralizer 1A. In FIG. 18, the pre-cleaning irradiator 1B irradiates the photoreceptor 11 from the substrate side thereof because the substrate is transparent in this embodiment.

Alternatively, the pre-cleaning irradiator 1B may irradiate the photoreceptor 11 from the photosensitive layer side thereof. Similarly, the image irradiator 13 and the neutralizer 1A each may irradiate the photoreceptor 11 from the substrate side thereof.

In addition to the image irradiator 13, the pre-cleaning irradiator 1B, and the neutralizer 1A, other members that irradiate the photoreceptor 11 with light, such as a pre-transfer irradiator and a pre-image irradiation irradiator, may be provided.

Figure 19:
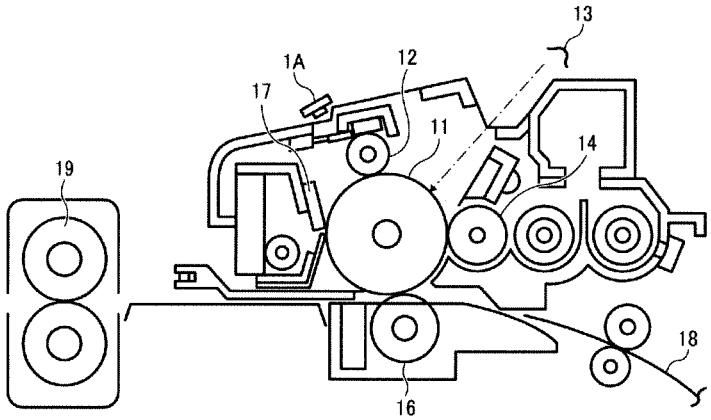
FIG. 19 is a schematic view illustrating an embodiment of the process cartridge according to this specification.

The above-described image forming unit is mountable on image forming apparatuses such as copiers, facsimile machines, and printers. Alternatively, the image forming unit may compose a process cartridge that is mountable on image forming apparatuses. FIG. 19 is a schematic view illustrating an embodiment of the process cartridge according to this specification. A photoreceptor 11 is the photoreceptor according to this specification, having the cross-linked resin surface layer satisfying the inequations (1-1) to (1-4) and (2-1) to (2-6). The photoreceptor 11 is in the form of a drum in FIG. 19. Alternatively, the photoreceptor 11 may be in the form of a sheet or an endless belt.

Figure 20:
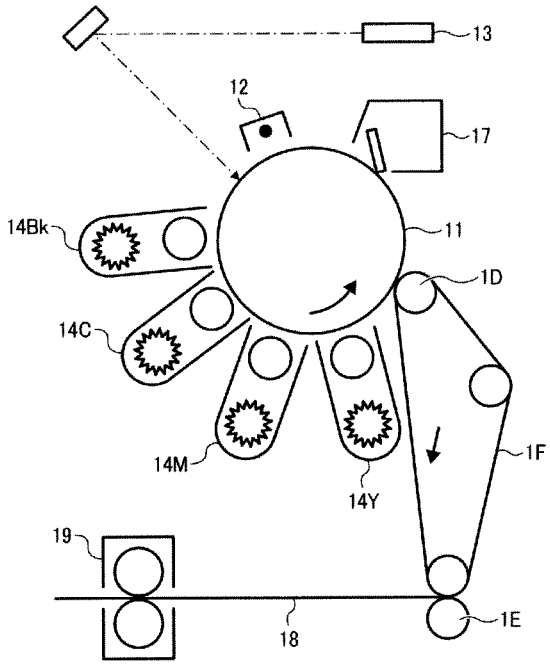
FIG. 20 is a schematic view illustrating another embodiment of the image forming unit according to this specification.

FIG. 20 is a schematic view illustrating another embodiment of the image forming unit.

Around a photoreceptor 11, a charger 12, an irradiator 13, a black developing device 14Bk, a cyan developing device 14C, a magenta developing device 14M, a yellow developing device 14Y, an intermediate transfer belt 1F, and a cleaner 17 are provided in this order. The additional characters Bk, C, M, and Y representing toner colors of black, cyan, magenta, and yellow, respectively, may be added or omitted as appropriate.

The photoreceptor 11 is the photoreceptor according to this specification, having the cross-linked resin surface layer satisfying the inequations (1-1) to (1-4) and (2-1) to (2-6). The developing devices 14Bk, 14C, 14M, and 14Y are independently controllable.

A first transferrer 1D transfers a toner image formed on the photoreceptor 11 onto the intermediate transfer belt 1F. The first transferrer 1D is provided inside the intermediate transfer belt 1F, and is movable so that the intermediate transfer belt 1F contacts with/separates from the photoreceptor 11. The intermediate transfer belt 1F is brought into contact with the photoreceptor 11 only during a toner image is transferred from the photoreceptor 11 onto the intermediate transfer belt 1F.

Each color toner image is sequentially formed and superimposed on one another on the intermediate transfer belt 1F to form a composite toner image. A second transferrer 1E transfers the composite toner image from the intermediate transfer belt 1F onto a recording medium 18. The composite toner image is fixed on the recording medium 18 in a fixing device 19. The second transferrer 1E is movable so as to contact with/separate from the intermediate transfer belt 1F. The second transferrer 1E is brought into contact with the intermediate transfer belt 1F only during the transfer of toner image.

A conventional image forming unit employing an intermediate transfer drum has a disadvantage that thick paper is not usable as the recording medium. This is because the recording medium is required to be flexible so as to be electrostatically adsorbed to the transfer drum and each color toner image is superimposed one another directly on the recording medium.

By contrast, in the image forming unit illustrated in FIG. 20 employing the intermediate transfer belt 1F has an advantage that usable recording medium are not limited to any particular material. This is because each color toner image is superimposed one another on the intermediate transfer belt 1F.

Figure 21:
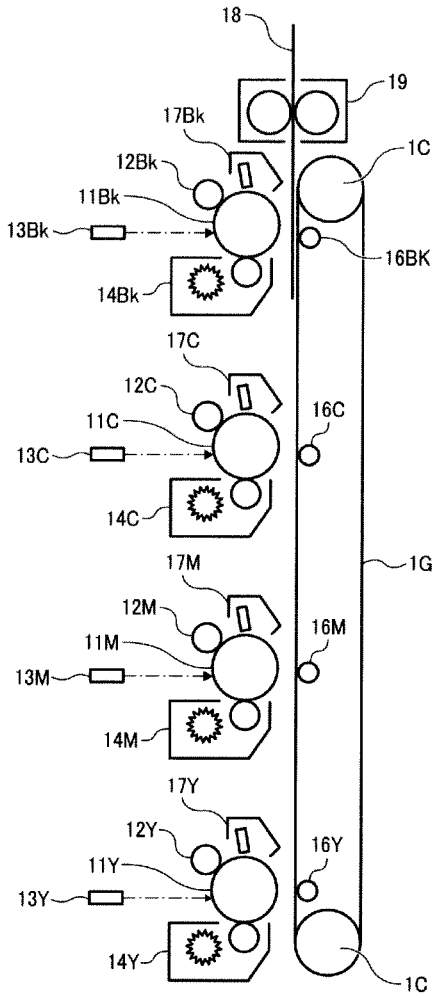
FIG. 21 is a schematic view illustrating yet another embodiment of the image forming unit according to this specification.

FIG. 21 is a schematic view illustrating another embodiment of the image forming unit. The image forming unit includes photoreceptors 11Y, 11M, 11C, and 11Bk. Each of the photoreceptors 11Y, 11M, 11C, and 11Bk is the photoreceptor according to this specification, having the cross-linked resin surface layer satisfying the inequations (1-1) to (1-4) and (2-1) to (2-6). Around the photoreceptor 11Y, a charger 12Y, an irradiator 13Y, a developing device 14Y, and a cleaner 17Y are provided. The same are provided around the photoreceptors 11M, 11C, and 11Bk as well. A conveyance transfer belt 1G is stretched taut between driving members 1C and contacts the photoreceptors 11Y, 11M, 11C, and 11Bk arranged in line. Transferrers 16Y, 16M, 16C, and 16Bk are provided on the opposite sides of the photoreceptors 11Y, 11M, 11C, and 11Bk, respectively, relative to the conveyance transfer belt 1G.

The image forming unit illustrated in FIG. 21 is what is called a tandem image forming unit in which yellow, magenta, cyan, and black toner images are formed on the respective photoreceptors 11Y, 11M, 11C, and 11Bk and are sequentially transferred onto a recording medium 18 on the conveyance transfer belt 1G. Such a tandem image forming unit is capable of printing full-color images at higher speeds compared to an image forming unit including only one photoreceptor.

Figure 22:
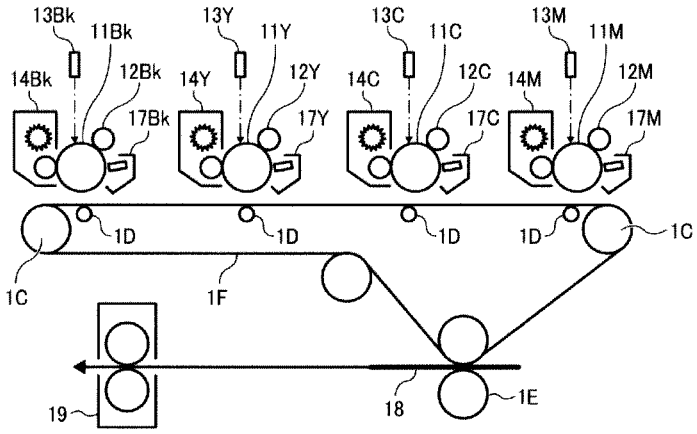
FIG. 22 is a schematic view illustrating further embodiment of the image forming unit according to this specification.

FIG. 22 is a schematic view illustrating another embodiment of the image forming unit. The image forming unit illustrated in FIG. 22 is a tandem image forming unit which employs an intermediate transfer belt 1F.

Next, exemplary embodiments of the solid lubricant applicator are described in detail.

Figure 23:
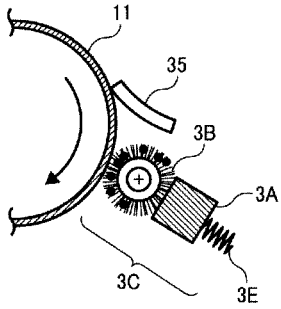
FIG. 23 is a schematic view illustrating an embodiment of the solid lubricant applicator according to this specification.

FIG. 23 is a schematic view illustrating an embodiment of the solid lubricant applicator. A solid lubricant applicator 3C includes a fur brush 3B, a solid lubricant 3A, and a pressing spring 3E for pressing the solid lubricant 3A against the fur brush 3B. The solid lubricant 3A is compressed into a bar. The tips of the brush fibers of the fur brush 3B are in contact with the photoreceptor 11. The solid lubricant 3A is drawn up on the fur brush 3B and is conveyed to the contact point of the fur brush 3B with the photoreceptor 11 by rotation of the fur brush 3B. Thus, the solid lubricant 3A is applied to the photoreceptor 11.

To express excellent receptivity to the solid lubricant, the photoreceptor 11 preferably rotates at a linear speed of from 150 to 250 mm/sec, more preferably from 180 to 220 mm/sec, so that 250 to 1,000 irregularities on the photoreceptor 11 passes by the solid lubricant applicator 3C per second.

The pressing spring 3E presses the solid lubricant 3A against the fur brush 3B at a predetermined pressure so that the solid lubricant 3A is constantly in contact with the fur brush 3B even when the solid lubricant 3A is abraded and reduced in volume with time.

In order to improve fixability of the solid lubricant 3A on the photoreceptor 11, a solid lubricant fixer may be provided.

The solid lubricant fixer may be, for example, a blade 35 that is provided in contact with the photoreceptor 11 so as to trail the photoreceptor 11. Alternatively, the blade 35 may be provided in contact with the photoreceptor 11 so as to face in the direction of rotation of the photoreceptor 11.

Specific examples of usable materials for the solid lubricant 3A include, but are not limited to, fatty acid metal salts such as lead oleate, zinc oleate, copper oleate, zinc stearate, cobalt stearate, iron stearate, copper stearate, zinc palmitate, copper palmitate, and zinc linolenate; and fluorine-containing resins such as polytetrafluoroethylene, polychlorotrifluoroethylene, polyvinylidene fluoride, polytrifluorochloroethylene, dichlorodifluoroethylene, tetrafluoroethylene-ethylene copolymer, and tetrafluoroethylene-oxafluoropropylene copolymer. Among these materials, metal salts of stearic acids, more specifically, zinc stearate is most preferable because it effectively reduces the friction coefficient of the photoreceptor 11.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, the procedures for evaluation of the below-prepared photoreceptors are described.

(1) Measurement of Surface Profile

A photoreceptor was set to a pickup (E-DT-S02A) and subjected to a measurement using a surface texture and contour measuring instrument SURFCOM 1400D (from Tokyo Seimitsu Co., Ltd.) to obtain text data of a cross-sectional curve of a surface of the photoreceptor. The evaluation length was 12 mm and the measuring speed was 0.06 mm/s.

Randomly selected 4 points on each photoreceptor were subjected to the above measurement. The text data of a cross-sectional curve obtained in each measurement was subjected to the wavelet transformation and multiresolution analysis, and WRa (μm) was calculated and averaged.

(2) Solid Lubricant Receptivity Test

Figure 24:
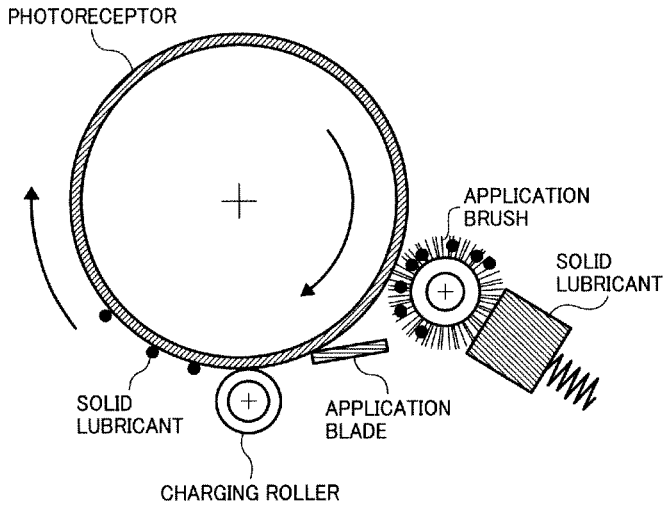
FIG. 24 is a schematic view illustrating a color copier used in a solid lubricant receptivity test.

A photoreceptor was mounted on a color printer IPSIO SP C811 (from Ricoh Co., Ltd.) to be subjected to a solid lubricant receptivity test. As the solid lubricant, zinc stearate was used. The color printer was partially modified so as to have a configuration illustrated in FIG. 24.

To keep the test conditions constant, a zinc stearate bar (i.e., a solid lubricant), an application brush, and an application blade were provided to a photoreceptor-developing device composite unit (hereinafter "PD unit"). To uniformly impregnate the zinc stearate to the application brush in advance, the PD unit was mounted on the color copier and idled for 30 minutes. The developer contained in the PD unit was completely removed.

Before mounting on the PD unit, the photoreceptor was subjected to surface observation with a laser microscope (VK-8500 from Keyence Corporation). After mounting the photoreceptor on the PD unit, the PD unit was mounted on the color copier and idled for 15 seconds. The photoreceptor was taken out of the PD unit and was subjected to the surface observation again to obtain an image of the surface.

Figure 25:
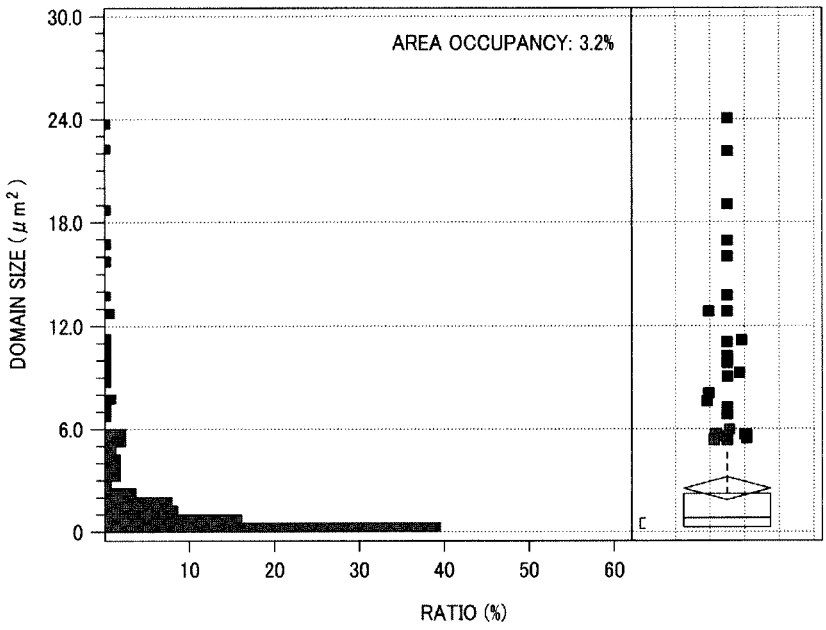
FIG. 25 is an example result of the image analysis in the solid lubricant receptivity test.

The image was subjected to an image analysis so that domains of zinc stearate remaining on the photoreceptor were distinguished and the size and the area occupancy of the domains were calculated with MEASURE and COUNT commands of an image analysis software program IMAGE PRO PLUS Ver 3.0 (from Media Cybernetics, Inc.). An example result of the image analysis is shown in FIG. 25. The solid lubricant receptivity was evaluated with the area occupancy of the domains of zinc stearate remaining on the photoreceptor after the 15-second idling.

(3) Image Evaluation

A halftone pattern with a pixel density of 600 dpi×600 dpi, in which 4 dots×4 dots are formed on an 8×8 matrix, and a blank pattern were alternately and independently produced on continuous 5 sheets of paper each. The blank pattern was visually observed to determine whether background was contaminated or not. The results were graded in the following 5 levels.

5: Very clean.
4: Clean.
3: No problem.
2: Slightly contaminated but no problem in practical use.
1: Contaminated.

Example 1

On an aluminum cylinder having a thickness of 0.8 mm, a length of 340 mm, and an outer diameter of 40 mm, a undercoat layer coating liquid, a charge generation layer coating liquid, and a charge transport layer coating liquid were sequentially coated and dried in this order. Thus, an undercoat layer, a charge generation layer, and a charge transport layer having a thickness of 3.5 μm, 0.2 μm, and 24 μm, respectively, were formed on the aluminum cylinder.

Tetrahydrofuran was sprayed on the surface of the charge transport layer at a spraying speed of 16 mm/s, a spraying pressure of 1.0 kgf/cm$^2$, and a spraying amount of 330 mg/s, while rotating the aluminum cylinder at a revolution of 160 rpm. This spraying operation was performed twice, each along in the opposite longitudinal direction. Thereafter, the aluminum cylinder was dried for 20 minutes at 135° C.

Further, a cross-linked resin surface layer coating liquid was spray-coated thereon, followed by drying for 15 minutes. The aluminum cylinder was put 120 mm away from a UV curing lamp so that the cross-linked resin surface layer coating liquid was subjected to UV curing while rotating at a revolution of 25 rpm. The illuminance at that position was 550 mW/cm$^2$ when measured with an accumulated UV meter UIT-150 from Ushio Inc. The aluminum cylinder was exposed to UV ray for 4 minutes while circulating water having a temperature of 30° C. therein, followed by drying for 30 minutes at 130° C. Thus, a photoreceptor having a cross-linked resin surface layer having a thickness of 6 μm was prepared.

The compositions of the coating layers are shown in Tables 2 to 5.

TABLE 2

Composition of Undercoat Layer Coating Liquid

| Components | Trade Name or Chemical Formula | Amount (parts) |
|---|---|---|
| Alkyd resin solution | BECKOLITE M6401-50 (from DIC Corporation) | 12 |
| Melamine resin solution | SUPER BECKAMINE G-821-60 (from DIC Corporation) | 8.0 |
| Titanium oxide | CR-EL (from Ishihara Sangyo Kaisha, Ltd.) | 40 |
| Methyl ethyl ketone | — | 200 |

TABLE 3

| Composition of Charge Generation Layer Coating Liquid | | |
|---|---|---|
| Components | Trade Name or Chemical Formula | Amount (parts) |
| Bisazo pigment | 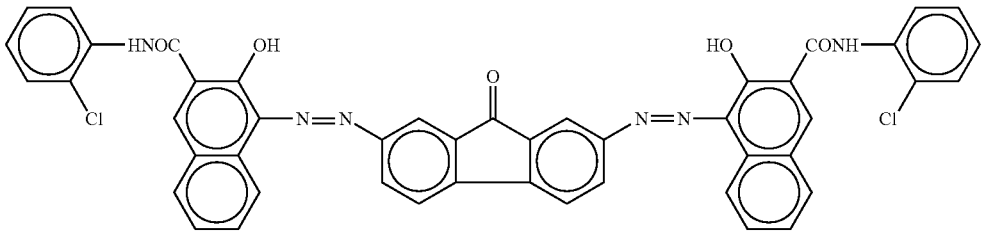 (from Ricoh Co., Ltd.) | 5.0 |
| Polyvinyl butyral | XYHL (from UCC) | 1 |
| Cyclohexanone | — | 200 |
| Methyl ethyl ketone | | 80 |

TABLE 4

| Composition of Charge Transport Layer Coating Liquid | | |
|---|---|---|
| Components | Trade Name or Chemical Formula | Amount (parts) |
| Z-type Polycarbonate | PANLITE ® TS-2050 (from Teijin Chemicals Ltd.) | 10 |
| Low-molecular-weight charge transport material | 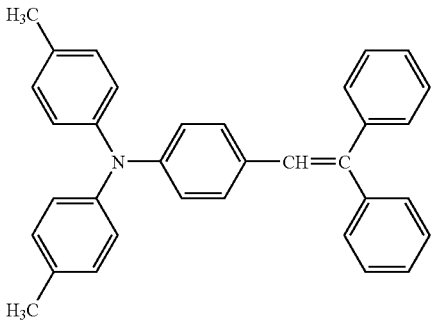 | 7.0 |
| Tetrahydrofuran | — | 100 |
| Silicone oil (in 1% THF solution) | KF50-100CS (from Shin-Etsu Chemical Co., Ltd.) | 1 |

TABLE 5

Composition of Cross-linked Resin Surface Layer Coating Liquid

| Components | Trade Name or Chemical Formula | Amount (parts) |
|---|---|---|
| Cross-linkable charge transport material | 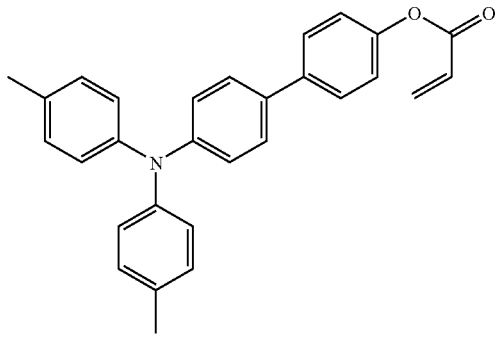 | 6.0 |
| Trimethylolpropane triacrylate | KAYARAD TMPTA (from Nippon Kayaku Co., Ltd.) | 3.0 |
| 50% THF solution of caprolactone-modified dipentaerythritol hexaacrylate | KAYARAD DPCA-120 (from Nippon Kayaku Co.. Ltd.) | 6.0 |
| 5% THF solution of a mixture of polyester-modified polydimethylsiloxane having acryl group and propoxy-modified 2-neopentylglycol diacrylate | BYK-UV3571 (from BYK Japan KK) | 0.24 |
| 1-Hydroxycyclohexyl phenyl ketone | IRGACURE ® 184 (from Ciba) | 0.60 |
| Tris(2,4-di-tert-butylphenyl) phosphate | — | 0.12 |
| Tetrahydrofuran | | 68.92 |

Example 2

The procedure in Example 1 was repeated except that tetrahydrofuran was sprayed on the surface of the charge transport layer at a spraying speed of 16 mm/s, a spraying pressure of 3.0 kgf/cm$^2$, and a spraying amount of 330 mg/s, while rotating the aluminum cylinder at a revolution of 100 rpm. This spraying operation was performed once.

Example 3

The procedure in Example 1 was repeated except that tetrahydrofuran was sprayed on the surface of the charge transport layer at a spraying speed of 11 mm/s, a spraying pressure of 2.0 kgf/cm$^2$, and a spraying amount of 330 mg/s, while rotating the aluminum cylinder at a revolution of 160 rpm. This spraying operation was performed once.

Example 4

The procedure in Example 1 was repeated except that tetrahydrofuran was sprayed on the surface of the charge transport layer at a spraying speed of 16 mm/s, a spraying pressure of 1.0 kgf/cm$^2$, and a spraying amount of 165 mg/s, while rotating the aluminum cylinder at a revolution of 160 rpm. This spraying operation was performed twice.

Example 5

The procedure in Example 4 was repeated except that tetrahydrofuran was sprayed on the surface of the charge transport layer at a spraying speed of 11 mm/s, a spraying pressure of 1.0 kgf/cm$^2$, and a spraying amount of 165 mg/s, while rotating the aluminum cylinder at a revolution of 100 rpm. This spraying operation was performed three times.

Comparative Example 1

The procedure in Example 1 was repeated except that tetrahydrofuran was sprayed on the surface of the charge transport layer at a spraying speed of 16 mm/s, a spraying pressure of 3.0 kgf/cm$^2$, and a spraying amount of 330 mg/s, while rotating the aluminum cylinder at a revolution of 40 rpm. This spraying operation was performed once.

Comparative Example 2

The procedure in Example 4 was repeated except that tetrahydrofuran was sprayed on the surface of the charge transport layer at a spraying speed of 11 mm/s, a spraying pressure of 2.0 kgf/cm$^2$, and a spraying amount of 165 mg/s, while rotating the aluminum cylinder at a revolution of 40 rpm. This spraying operation was performed three times.

Comparative Example 3

The procedure in Example 1 was repeated except that the cross-linked resin surface layer was not formed.

Comparative Example 4

The procedure in Example 1 was repeated except that tetrahydrofuran was not sprayed on the surface of the charge transport layer.

Comparative Example 5

The procedure in Comparative Example 4 was repeated except that the cross-linked resin surface layer coating liquid was replaced with another coating liquid having the composition shown in Table 6.

TABLE 6

| Components | Trade Name or Chemical Formula | Amount (parts) |
|---|---|---|
| Z-type Polycarbonate | PANLITE ® TS-2050 (from Teijin Chemicals Ltd.) | 10 |
| Low-molecular-weight charge transport material | 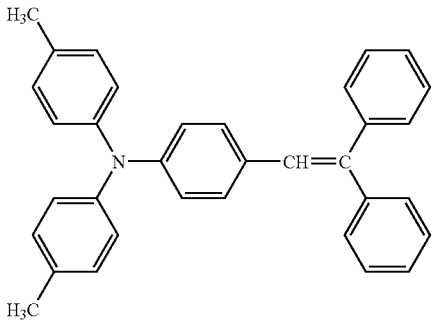 | 7.0 |
| α-Alumina | SUMICORUNDUM AA-03 (from Sumitomo Chemical Co., Ltd.) | 5.7 |
| Disperser | BYK-P104 (from BYK Japan KK) | 0.014 |
| Tetrahydrofuran | — | 280 |
| Cyclohexanone | — | 80 |

Each of the photoreceptors prepared in Examples 1 to 5 and Comparative Examples 1 to 5 each having a diameter of 40 mm was mounted on a yellow development station of an image forming apparatus IPSIO SP C811 (from Ricoh Co., Ltd.) to be subjected to the solid lubricant receptivity test. The linear speed of the photoreceptor was 205 mm/s. The zinc stearate and spring, which were genuine parts of the image forming apparatus, were used without modification.

The photoreceptor-developing device composite unit (i.e., PD unit) was also a genuine part. The voltage applied to the charging roller included an AC component having a peak-to-peak voltage of 1.5 kV and a frequency of 0.9 kHz, and a DC component including a bias which charges the photoreceptor to −700 V at the beginning of the test. This charging condition was maintained throughout the test. No neutralization device was provided to the image forming apparatus.

Next, each of the photoreceptors prepared in Examples 1 to 5 and Comparative Examples 1 to 5 each having a diameter of 40 mm was mounted on a black development station of an image forming apparatus IPSIO SP C811 (from Ricoh Co., Ltd.). A printing job, in which a halftone pattern with a pixel density of 600 dpi×600 dpi, in which 4 dots×4 dots are formed on an 8×8 matrix, and a blank pattern were alternately and independently produced on continuous 5 sheets of paper each, was repeatedly executed, so that 50,000 sheets were produced in total. The paper was MY PAPER A4 (from NBS Ricoh) and the toner and developer were genuine parts of the image forming apparatus. The toner was a polymerization toner.

The photoreceptor unit was a genuine part. The voltage applied to the charging roller included an AC component having a peak-to-peak voltage of 1.5 kV and a frequency of 0.9 kHz, and a DC component including a bias which charges the photoreceptor to −700 V at the beginning of the test. This charging condition was maintained throughout the test. No neutralization device was provided to the image forming apparatus. The cleaning unit, which was a genuine part, was replaced with an unused one at every 50,000 sheets. After the test, a color test chart was produced on a PPC paper TYPE 6200A3. The test was performed at 25° C., 55% RH.

Figure 26:
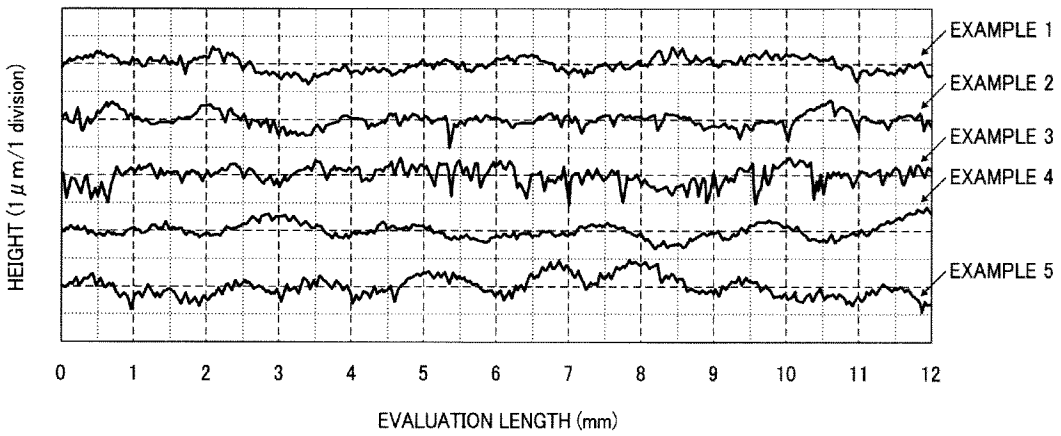
FIGS. 26 and 27 show the primary surface profiles of the photoreceptors manufactured in Examples 1-5 and Comparative Examples 1-5.
Figure 27:
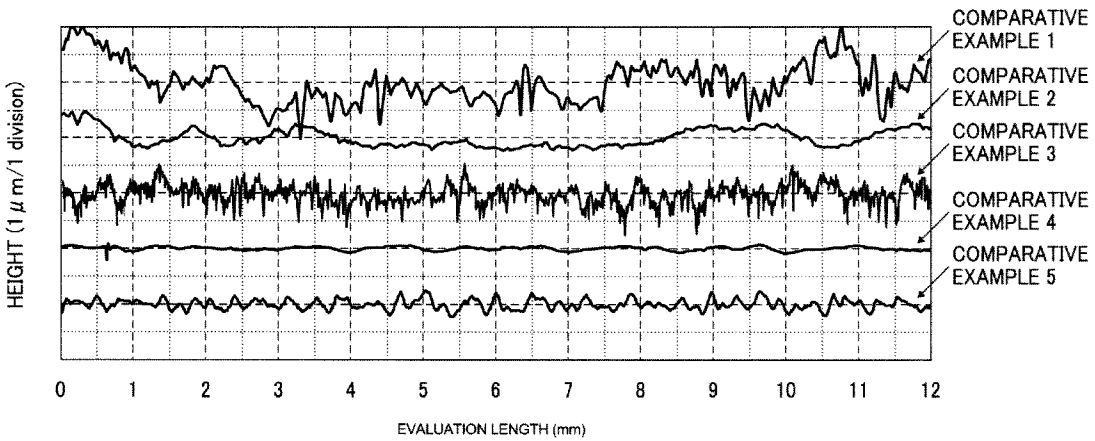
Figure 28:
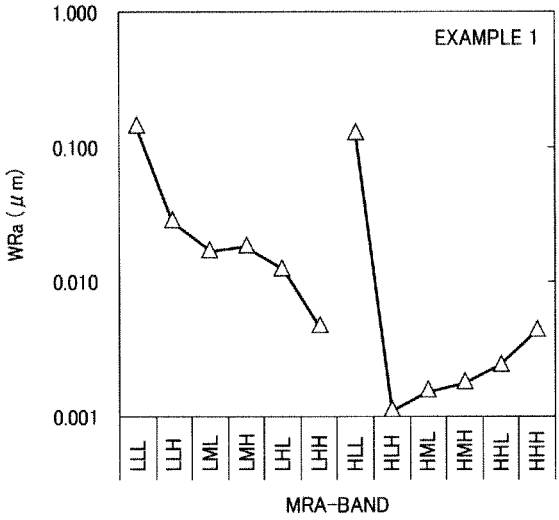
FIGS. 28 to 37 show the measurement results of WRa in Examples 1-5 and Comparative Examples 1-5.
Figure 29:
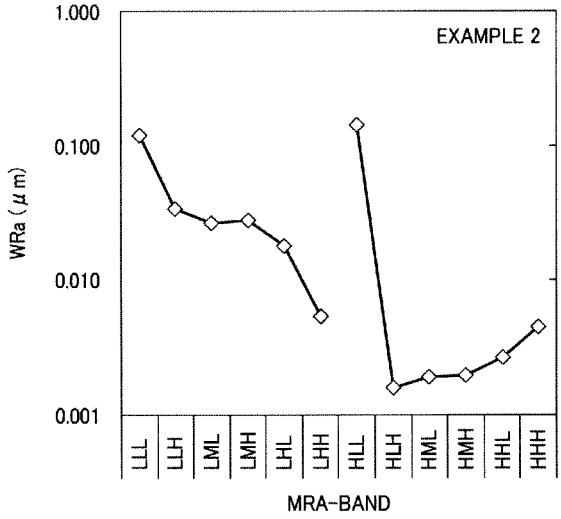
Figure 30:
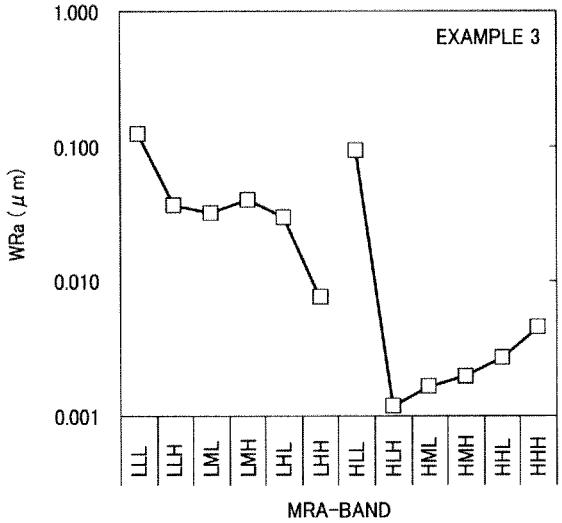
Figure 31:
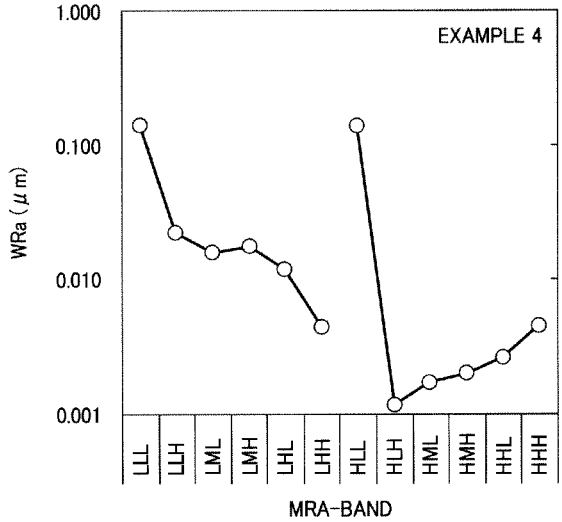
Figure 32:
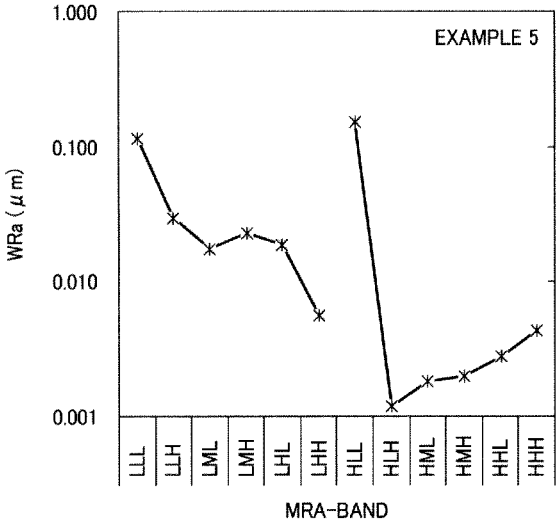
Figure 33:
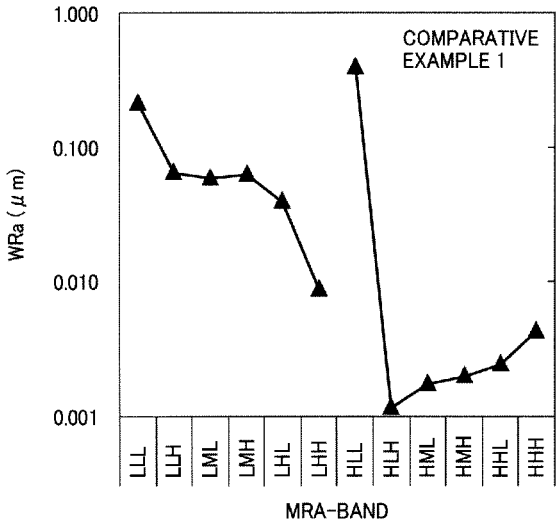
Figure 34:
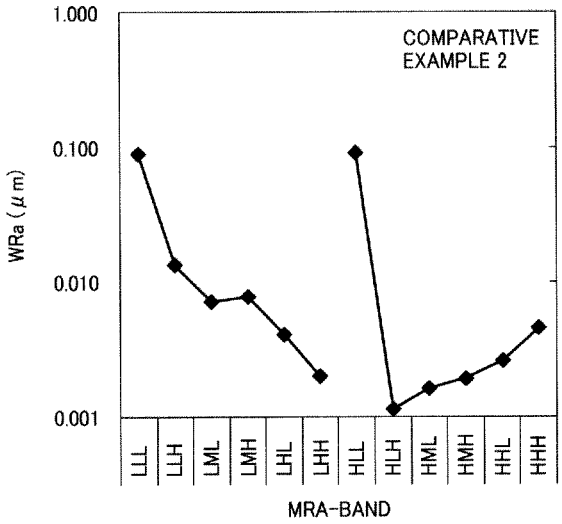
Figure 35:
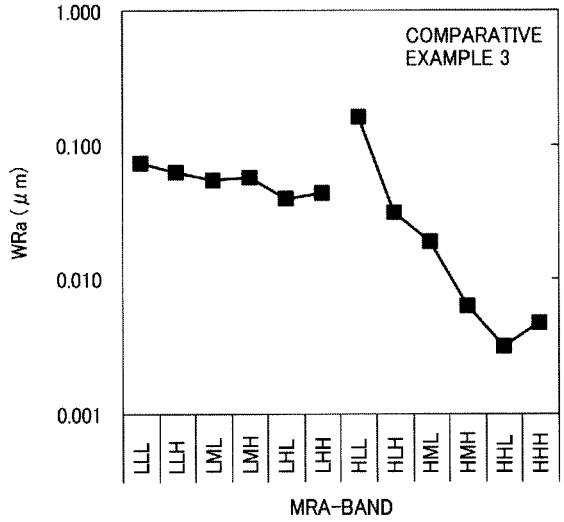
Figure 36:
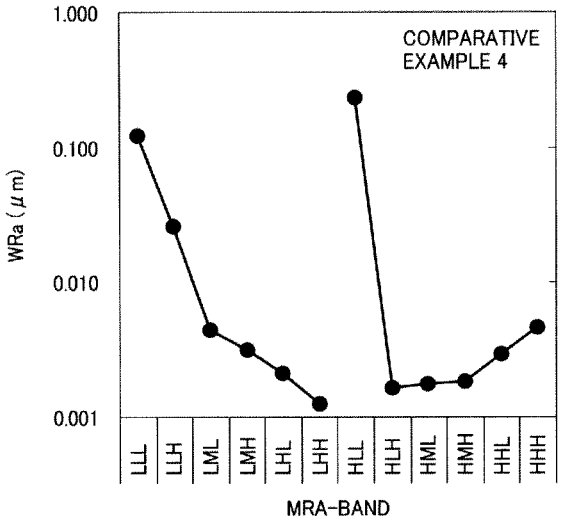
Figure 37:
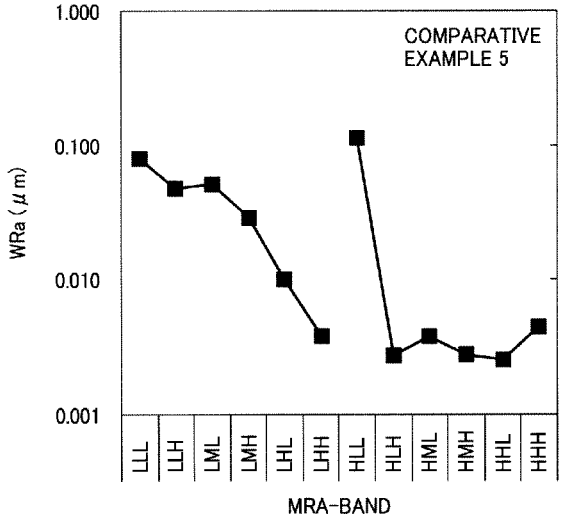

The primary surface profiles of the resultant photoreceptors are shown in FIGS. 26 and 27. The roughness spectra of the resultant photoreceptors are shown in FIGS. 28 to 37. The measurement results of WRa of the resultant photoreceptors are shown in Tables 7-1 and 7-2. These results show that Examples 1 to 5 satisfy the inequations (1-1) to (1-4) and (2-1) to (2-6), but Comparative Examples 1 to 5 do not.

Further, the measurement results of WRa of the roughened charge transport layer, which are measured before forming the cross-linked resin surface layer thereon, are shown in Tables 8-1 and 8-2. These results show that Examples 1 to 5 satisfy the inequations (3-1) to (3-4), but Comparative Examples 1 and 2 do not.

TABLE 7-1

| | WRa (μm) | | | | | |
|---|---|---|---|---|---|---|
| | LLL | LLH | LML | LMH | LHL | LHH |
| Example 1 | 0.1402 | 0.0283 | 0.0169 | 0.0189 | 0.0124 | 0.0047 |
| Example 2 | 0.1195 | 0.0341 | 0.0262 | 0.0276 | 0.0182 | 0.0053 |
| Example 3 | 0.1227 | 0.0365 | 0.0318 | 0.0392 | 0.0294 | 0.0075 |
| Example 4 | 0.1390 | 0.0222 | 0.0157 | 0.0175 | 0.0118 | 0.0043 |
| Example 5 | 0.1173 | 0.0303 | 0.0176 | 0.0229 | 0.0187 | 0.0056 |
| Comparative Example 1 | 0.2155 | 0.0666 | 0.0592 | 0.0630 | 0.0396 | 0.0090 |
| Comparative Example 2 | 0.0890 | 0.0136 | 0.0072 | 0.0079 | 0.0041 | 0.0020 |
| Comparative Example 3 | 0.0732 | 0.0618 | 0.0538 | 0.0572 | 0.0396 | 0.0436 |
| Comparative Example 4 | 0.1213 | 0.0256 | 0.0044 | 0.0031 | 0.0021 | 0.0013 |
| Comparative Example 5 | 0.0722 | 0.4128 | 0.9334 | 1.0356 | 0.6917 | 0.4317 |

TABLE 7-2

| | WRa (μm) | | | | | |
|---|---|---|---|---|---|---|
| | HLL | HLH | HML | HMH | HHL | HHH |
| Example 1 | 0.1298 | 0.0011 | 0.0016 | 0.0018 | 0.0024 | 0.0043 |
| Example 2 | 0.1426 | 0.0016 | 0.0019 | 0.0020 | 0.0027 | 0.0045 |
| Example 3 | 0.0900 | 0.0012 | 0.0016 | 0.0019 | 0.0027 | 0.0045 |

TABLE 7-2-continued

| | WRa (μm) | | | | | |
|---|---|---|---|---|---|---|
| | HLL | HLH | HML | HMH | HHL | HHH |
| Example 4 | 0.1402 | 0.0012 | 0.0017 | 0.0020 | 0.0026 | 0.0045 |
| Example 5 | 0.1511 | 0.0012 | 0.0018 | 0.0020 | 0.0028 | 0.0044 |
| Comparative Example 1 | 0.4019 | 0.0012 | 0.0018 | 0.0020 | 0.0025 | 0.0044 |
| Comparative Example 2 | 0.0898 | 0.0011 | 0.0016 | 0.0019 | 0.0026 | 0.0045 |
| Comparative Example 3 | 0.1580 | 0.0308 | 0.0190 | 0.0062 | 0.0031 | 0.0047 |
| Comparative Example 4 | 0.2325 | 0.0016 | 0.0018 | 0.0018 | 0.0029 | 0.0046 |
| Comparative Example 5 | 0.1468 | 0.3962 | 0.4066 | 0.1633 | 0.0299 | 0.0116 |

TABLE 8-1

| | WRa (μm) | | | | | |
|---|---|---|---|---|---|---|
| | LLL | LLH | LML | LMH | LHL | LHH |
| Example 1 | 0.0732 | 0.0618 | 0.0538 | 0.0572 | 0.0396 | 0.0436 |
| Example 2 | 0.0994 | 0.0343 | 0.0208 | 0.0224 | 0.0148 | 0.0133 |
| Example 3 | 0.0680 | 0.0394 | 0.0316 | 0.0404 | 0.0287 | 0.0248 |
| Example 4 | 0.0718 | 0.0332 | 0.0222 | 0.0359 | 0.0267 | 0.0215 |
| Example 5 | 0.0780 | 0.0306 | 0.0239 | 0.0299 | 0.0242 | 0.0223 |
| Comparative Example 1 | 0.1763 | 0.0837 | 0.0641 | 0.0592 | 0.0515 | 0.0423 |
| Comparative Example 2 | 0.0534 | 0.0284 | 0.0162 | 0.0300 | 0.0085 | 0.0067 |
| Comparative Example 3 | — | — | — | — | — | — |
| Comparative Example 4 | — | — | — | — | — | — |
| Comparative Example 5 | — | — | — | — | — | — |

TABLE 8-2

| | WRa (μm) | | | | | |
|---|---|---|---|---|---|---|
| | HLL | HLH | HML | HMH | HHL | HHH |
| Example 1 | 0.1580 | 0.0308 | 0.0190 | 0.0062 | 0.0031 | 0.0047 |
| Example 2 | 0.0956 | 0.0063 | 0.0049 | 0.0026 | 0.0026 | 0.0045 |
| Example 3 | 0.1256 | 0.0122 | 0.0080 | 0.0032 | 0.0028 | 0.0046 |
| Example 4 | 0.1390 | 0.0111 | 0.0055 | 0.0028 | 0.0031 | 0.0042 |
| Example 5 | 0.1524 | 0.0101 | 0.0072 | 0.0027 | 0.0027 | 0.0045 |
| Comparative Example 1 | 0.3148 | 0.0170 | 0.0095 | 0.0035 | 0.0027 | 0.0046 |
| Comparative Example 2 | 0.0814 | 0.0028 | 0.0037 | 0.0022 | 0.0027 | 0.0045 |
| Comparative Example 3 | — | — | — | — | — | — |
| Comparative Example 4 | — | — | — | — | — | — |
| Comparative Example 5 | — | — | — | — | — | — |

The results of the solid lubricant receptivity test and the image evaluation are shown in Table 9.

TABLE 9

| | Solid lubricant receptivity (Area occupancy (%) of zinc stearate on photoreceptor) | Image evaluation (Rank) |
|---|---|---|
| Example 1 | 9.0 | 4 |
| Example 2 | 11 | 4 |
| Example 3 | 10 | 4 |
| Example 4 | 12 | 5 |
| Example 5 | 10 | 4 |
| Comparative Example 1 | 4.2 | 2 |
| Comparative Example 2 | 5.0 | 2 |
| Comparative Example 3 | 0.60 | 1 |
| Comparative Example 4 | 2.0 | 1 |
| Comparative Example 5 | 3.8 | 2 |

The photoreceptors of Examples 1 to 5 satisfy the inequations (1-1) to (1-4) and (2-1) to (2-6). They have better solid lubricant receptivity than the photoreceptors of Comparative Examples 1 to 5 which do not satisfy the inequations (1-1) to (1-4) and (2-1) to (2-6). However, it is clear from the results of Comparative Examples 1 and 2 that roughening of the surface not always improves solid lubricant receptivity.

When the surface of a photoreceptor has a surface with an appropriate roughness, i.e., the inequations (1-1) to (1-4) and (2-1) to (2-6) are satisfied, a solid lubricant does not sideslip on the photoreceptor and an application blade causes appropriate variation in linear pressure, both of which may result in improvement of solid lubricant receptivity. The former is achieved by forming a high-frequency irregularities and the latter is achieved by forming a low-frequency irregularities.

Such a surface with an appropriate roughness provides excellent solid lubricant receptivity.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor, comprising:

a conductive substrate;

a photosensitive layer located overlying the conductive substrate; and a cross-linked resin surface layer comprising a cross-linked resin having a charge transport structure, located overlying the photosensitive layer, wherein the following inequations are satisfied:

$$0.01<WRa(LLH)<0.04 \quad (1\text{-}1)$$

$$0.01<WRa(LML)<0.04 \quad (1\text{-}2)$$

$$0.01<WRa(LMH)<0.04 \quad (1\text{-}3)$$

$$0.01<WRa(LHL)<0.04 \quad (1\text{-}4)$$

$$WRa(LHL)>WRa(LHH) \quad (2\text{-}1)$$

$$WRa(LHL)>WRa(HLH) \quad (2\text{-}2)$$

$$WRa(LHL)>WRa(HML) \quad (2\text{-}3)$$

$$WRa(LHL)>WRa(HMH) \quad (2\text{-}4)$$

$$WRa(LHL)>WRa(HHL) \quad (2\text{-}5)$$

$$WRa(LHL)>WRa(HHH) \quad (2\text{-}6)$$

wherein WRa (μm) represents an arithmetic average roughness according to JIS-B0601:2001of frequency components that are obtained by a method comprising:

subjecting a one-dimensional data array of a surface profile of the electrophotographic photoreceptor, measured with a surface roughness and profile shape measuring instrument, to a wavelet transformation multiresolution analysis so as to be separated into six frequency components, HHH, HHL, HMH, HML, HLH, and HLL, each having a cycle length (μm) of 0 to 3, 1 to 6, 2 to 13, 4 to 25, 10 to 50, and 24 to 99, respectively;

thinning a one-dimensional data array of the lowest frequency component HHL having a cycle length of from 24 to 99 (μm) so that the number of data arrays is reduced to from 1/10 to 1/100; and subjecting the thinned one-dimensional data array to the wavelet transformation multiresolution analysis so as to be separated into six frequency components, LHH, LHL, LMH, LML, LLH, and LLL, each having a cycle length (μm) of 26 to 106, 53 to 183, 106 to 318, 214 to 551, 431 to 954, and 867 to 1,654, respectively.

2. The electrophotographic photoreceptor according to claim 1, wherein the charge transport structure is a triarylamine structure.

3. A process cartridge, comprising:

the electrophotographic photoreceptor according to claim 1; and a solid lubricant applicator including:

a solid lubricant;

a brush-shaped roller that scrapes the solid lubricant and applies the scraped solid lubricant to a surface of the electrophotographic photoreceptor; and a blade that evenly spreads the solid lubricant over the surface of the electrophotographic photoreceptor.

4. An image forming apparatus, comprising:

at least one process unit each including:

the electrophotographic photoreceptor according to claim 1 to bear an electrostatic latent image;

a solid lubricant applicator including:

a solid lubricant;

a brush-shaped roller that scrapes the solid lubricant and applies the scraped solid lubricant to a surface of the electrophotographic photoreceptor; and a blade that evenly spreads the solid lubricant over the surface of the electrophotographic photoreceptor; and a developing device that develops the electrostatic latent image with a toner to form a toner image.

5. The image forming apparatus according to claim 4, wherein the image forming apparatus includes two or more process units each containing a different color of toner, and the process units are arranged in tandem.

* * * * *